US012540619B2

(12) United States Patent
Wang et al.

(10) Patent No.: US 12,540,619 B2
(45) Date of Patent: Feb. 3, 2026

(54) MULTIFUNCTIONAL VACUUM PUMP

(71) Applicant: JINHUA WEIKE INDUSTRIAL & TRADING CO., LTD, Jinhua (CN)

(72) Inventors: Desheng Wang, Jinhua (CN); Heng Wang, Jinhua (CN); Zong Wang, Jinhua (CN)

(73) Assignee: JINHUA WEIKE INDUSTRIAL & TRADING CO., LTD, Jinhua (CN)

( * ) Notice: Subject to any disclaimer, the term of this patent is extended or adjusted under 35 U.S.C. 154(b) by 0 days.

(21) Appl. No.: 19/056,805

(22) Filed: Feb. 19, 2025

(65) Prior Publication Data

US 2025/0305499 A1 Oct. 2, 2025

Related U.S. Application Data

(63) Continuation of application No. PCT/CN2024/089229, filed on Apr. 23, 2024.

(30) Foreign Application Priority Data

Mar. 27, 2024 (CN) ..... 202410358803.8

(51) Int. Cl.
*F04C 23/00* (2006.01)
*F04C 18/344* (2006.01)
(Continued)

(52) U.S. Cl.
CPC ..... *F04C 23/001* (2013.01); *F04C 18/3441* (2013.01); *F04C 25/02* (2013.01);
(Continued)

(58) Field of Classification Search
CPC .... F04C 23/001; F04C 18/3441; F04C 25/02; F04C 29/0007; F04C 29/0092; F04C 29/025; F04C 29/026
See application file for complete search history.

(56) References Cited

U.S. PATENT DOCUMENTS 3,399,826 A * 9/1968 Andriulis ..... F04C 23/001 418/79

FOREIGN PATENT DOCUMENTS

CN 101929450 A 12/2010
CN 103629113 A 3/2014
(Continued)

OTHER PUBLICATIONS

Chinese Patent Publication and Machine Translation for CN 103629113 A; 1st Inventor: Jiang; Title: Oil Tank Side Two-stage Rotary Vane Vacuum Pump; Published: Jul. 19, 2013. (Year: 2013).*
(Continued)

*Primary Examiner* — Mary A Davis
(74) *Attorney, Agent, or Firm* — Bayramoglu Law Offices

(57) ABSTRACT

A multifunctional vacuum pump includes a shell. A vacuum pump assembly and an oil tank assembly are arranged in the shell, the vacuum pump assembly includes an oil pump assembly and a motor assembly, a condenser is arranged below the oil tank assembly, and an oil inlet tube is arranged between the condenser and the oil pump assembly; the oil tank assembly includes an oil tank body, and discharge outlets are formed in the oil tank body and connected to the oil pump assembly; an oil mist filter assembly is arranged above the discharge outlets and includes an upper protective cover, a lower protective cover and filter elements; an elastic sheet assembly is arranged between the discharge outlets and the upper protective cover; a gas ballast assembly is arranged on the shell and includes a rotary knob and a nozzle; a gas inlet assembly is arranged on the shell.

7 Claims, 15 Drawing Sheets

(51) Int. Cl.

| | |
|---|---|
| ***F04C 25/02*** | (2006.01) |
| ***F04C 29/00*** | (2006.01) |
| ***F04C 29/02*** | (2006.01) |

(52) U.S. Cl.
CPC ..... *F04C 29/0007* (2013.01); *F04C 29/0092* (2013.01); *F04C 29/025* (2013.01); *F04C 29/026* (2013.01)

(56) References Cited

FOREIGN PATENT DOCUMENTS

| | | | | |
|---|---|---|---|---|
| CN | 107023485 | A | 8/2017 | |
| CN | 107842502 | A | 3/2018 | |
| CN | 109915377 | A | 6/2019 | |
| CN | 212583942 | U | 2/2021 | |
| CN | 112761955 | A | 5/2021 | |
| CN | 213205943 | U | 5/2021 | |
| CN | 213627999 | U | 7/2021 | |
| CN | 218760428 | U | 3/2023 | |
| GB | 1509376 | A | 5/1978 | |
| KR | 20210079548 | A | 6/2021 | |
| WO | WO-2009062931 | A2 * | 5/2009 | ..... F04C 29/026 |

OTHER PUBLICATIONS

Chinese Patent Publication and Machine Translation for CN 212583942 U; 1st Inventor: Cui; Title: An Environment-friendly Single-stage Rotary-vane Vacuum Pump; Published: Feb. 23, 2021. (Year: 2021).*

Instruction Manual: RV3, RV5, RV8 and RV12 Rotary Vane Pumps, BOC Edwards, 2005, Issue A652-01-880, Issue P.

* cited by examiner

MULTIFUNCTIONAL VACUUM PUMP

CROSS-REFERENCE TO THE RELATED APPLICATIONS

This application is a continuation application of International Application No. PCT/CN2024/089229, filed on Apr. 23, 2024, which is based upon and claims priority to Chinese Patent Application No. 202410358803.8, filed on Mar. 27, 2024, the entire contents of which are incorporated herein by reference.

TECHNICAL FIELD

The invention belongs to the technical field of vacuum pumps, and particularly relates to a multifunctional vacuum pump.

BACKGROUND

A vacuum pump is a device used to create a vacuum by removing gas from a container and is widely applied to the metallurgical industry, the chemical industry, the food industry, the electronic coating industry and other industries. Because the container is not perfectly clean, impurities in the container, such as water vapor and particulate matter, easily enter a pump body of the vacuum pump. If these impurities cannot be discharged in time, the vacuumizing efficiency of the vacuum pump will be affected. Existing vacuum pumps typically comprise a pump body, an oil tank and a gas ballast switch, wherein when the pump body operates, gas is drawn into a pump chamber and then enters the oil tank from the pump chamber. Generally, there is not a filter structure between the oil tank and the pump body in the prior art, and gas and impurities directly enter the oil tank from the pump chamber, so the purity of pump oil in the oil tank will be reduced, and the impurities will return into the pump chamber; moreover, water vapor will enter the oil tank from the pump chamber to be combined with the pump oil to generate a large quantity of oil mist, affecting the vacuumizing efficiency; in addition, the impurities will return into the pump chamber with the pump oil, affecting the working effect of the pump body. At present, gas ballast switches are used to feed dry gas into the pump chamber to avoid the condensation of water vapor to reduce the quantity of oil mist generated in the oil tank. However, existing gas ballast switches are complex in structure and low in reliability. So, a multifunctional vacuum pump needs to be designed to overcome these defects.

SUMMARY

In view of the problems in the prior art, the invention designs a multifunctional vacuum pump. An oil mist filter assembly is arranged in an oil tank of the multifunctional vacuum pump, and impurities are retained in a box formed by protective covers by means of filter elements, such that pump oil flowing back into the oil tank is purer, and the generation of a large quantity of oil mist in the oil tank is avoided; moreover, the on state of an oil pump assembly is quickly controlled by means of a gas ballast assembly to reduce the quantity of water vapor and impurities entering the oil tank, such that the vacuumizing efficiency is greatly improved, and the stability and reliability are guaranteed.

The objective of the invention is fulfilled by the following technical solution: a multifunctional vacuum pump comprises a shell, wherein a vacuum pump assembly and an oil tank assembly are arranged in the shell, the vacuum pump assembly comprises an oil pump assembly and a motor assembly, a condenser connected to the oil tank assembly is arranged below the oil tank assembly, and an oil inlet tube connecting the condenser and the oil pump assembly is arranged between the condenser and the oil pump assembly; the oil tank assembly comprises an oil tank body, and discharge outlets are formed in the oil tank body and connected to the oil pump assembly; an oil mist filter assembly is arranged above the discharge outlets and comprises an upper protective cover, a lower protective cover and filter elements; an elastic sheet assembly for controlling the discharge outlets to be opened or closed is arranged between the discharge outlets and the upper protective cover; a gas ballast assembly connected to the oil pump assembly is arranged on the shell and comprises a rotary knob and a nozzle, and when the rotary knob is rotated with respect to the shell, the nozzle is in an on or off state; a gas inlet assembly connected to the oil pump assembly is arranged on the shell, and a gas outlet assembly is arranged on a side face of the oil tank body.

Preferably, the oil pump assembly comprises a pump cover, a first-stage pump housing, a second-stage pump housing, a first end cover and a second end cover; the first end cover is connected to the pump cover, the pump cover is connected to the second-stage pump housing, the second-stage pump housing is connected to the first-stage pump housing, the first-stage pump housing is connected to the second end cover, and the second end cover is connected to the motor assembly; a long rotor and a pair of long blades are arranged in the first-stage pump housing, and a short rotor and a pair of short blades are arranged in the second-stage pump housing; an oil pump rotor rotating synchronously with the short rotor is arranged on the short rotor, the short rotor and the long rotor rotate synchronously, and the long rotor and the motor assembly rotate synchronously; first springs are arranged between the two long blades, and second springs are arranged between the two short blades; the second-stage pump housing is connected to the oil tank body, and a first passage connecting the second-stage pump housing and the oil inlet tube is arranged in the oil tank body; the second-stage pump housing is connected to the gas ballast assembly, and the second end cover is connected to the gas inlet assembly.

The gas inlet assembly is connected to a container to be vacuumized; a power switch is turned on, the motor assembly operates to drive the long rotor to rotate, the long rotor, when rotating, drives the short rotor to rotate, and the short rotor, when rotating, drives the oil pump rotor to rotate synchronously, such that the long blades rotate in the first-stage pump housing, and the short blades rotate in the second-stage pump housing; gas enters the first-stage pump housing first by means of the second end cover, and when the long blades rotate continuously, the gas in the first-stage pump housing will be compressed; then, the gas enters the second-stage pump housing, and when the short blades rotate continuously, the gas in the second-stage pump housing will be compressed. After that, the gas enters the oil tank body from the second-stage pump housing along the discharge outlets; then, the gas and pump oil are filtered by the oil mist filter assembly; and the filtered gas and pump oil return into a chamber of the oil tank body and are finally discharged outdoors by means of the gas outlet assembly. By means of two-stage compression of the oil pump assembly, a better vacuumizing effect is realized; pump oil is fed into the oil pump assembly for sealing, such that the sealing performance is better, and the vacuumizing process is more reliable. The gas ballast assembly can reduce the generation of oil mist and reduce the quantity of oil mist entering the oil tank body.

Preferably, the oil tank assembly is arranged above the oil pump assembly and further comprises an oil guard and an oil tank cap; the oil guard is arranged at an open end of the oil tank body, and the oil tank cap is threadedly connected to the oil tank body; a socket extending vertically is arranged on an end cover of the oil tank body, and an indicator light circuit board is arranged in the socket; a main control circuit board is arranged below the oil pump assembly, the indicator light circuit board is electrically connected to the gas ballast assembly, and the gas ballast assembly is electrically connected to the main control circuit board; the discharge outlets are arranged in a chamber of the oil tank body side-by-side, the elastic sheet assembly is arranged on the discharge outlets, and the oil mist filter assembly fitting the oil tank body is arranged above the elastic sheet assembly; a plurality of mounting holes are uniformly formed in a bottom of the oil tank body, and the condenser is arranged below the mounting holes; a sight glass is arranged on an end surface, facing the socket, of the oil tank body, a stationary press plate connected to the oil tank body is arranged on an outer side of the sight glass, and a sealing strip is arranged between the sight glass and the oil tank body; the gas outlet assembly is arranged on an outer wall of the oil tank body.

The oil guard can prevent pump oil from spilling over when the oil tank body shakes; the socket is transparent and extends into the oil tank body, such that the indicator light circuit board can be mounted easily and occupy little space; the sight glass is also transparent, such that the level of pump oil in the oil tank body can be observed easily, and the state of an indicator light on the indicator light circuit board can also be observed; the indicator light circuit board is electrically connected to the gas ballast assembly, and the gas ballast circuit board on the gas ballast assembly is electrically connected to the main control circuit board; when the gas ballast assembly is in an on state, the indicator light flickers red and blue; when the gas ballast assembly is in an off state, the indicator light is blue, such that users can visually learn about the on/off state of the gas ballast assembly. The elastic sheet assembly is arranged on the discharge outlets, and after being compressed in the second-stage pump housing, gas will impact the elastic sheet assembly, and then the gas and pump oil enter the oil mist filter assembly to be filtered, such that impurities in the gas are prevented from directly entering the chamber of the oil tank body. The condenser is arranged below the oil tank body, and the pump oil returns into the oil pump assembly after being cooled, such that the pump oil can be cyclically cooled in use, and the oil pump assembly can operate for a long time. The gas outlet assembly is arranged on the outer wall of the oil tank body and is used to further filter the gas, such that the gas discharged to the outside is purer, and user experience is better.

Preferably, the gas ballast assembly comprises the rotary knob, the nozzle, a gas ballast link, a copper contact piece, a gas ballast circuit board, a gas ballast plug sleeve, a gas ballast plug and a gas ballast housing; the gas ballast link and the rotary knob are mounted on two sides of the shell respectively; a mounting groove for mounting the gas ballast link is formed in the shell, and the gas ballast link and the gas ballast plug sleeve are connected and rotate synchronously; the gas ballast plug rotating synchronously with the gas ballast plug sleeve is arranged in the gas ballast plug sleeve and disposed around the nozzle; the gas ballast housing is disposed around an outer layer of the gas ballast plug sleeve, and the gas ballast plug sleeve is able to rotate with respect to the gas ballast housing; the gas ballast circuit board is arranged between a head end of the gas ballast housing and the mounting groove, and first fasteners are arranged between the gas ballast housing and the mounting groove; the copper contact piece is mounted on the gas ballast link and rotates synchronously with the gas ballast link, and a contact on the copper contact piece faces contacts on the gas ballast circuit board; a first vent hole is formed in the gas ballast plug sleeve, a second vent hole is formed in the gas ballast plug, and a third vent hole is formed in the nozzle; the gas ballast circuit board is electrically connected to the indicator light circuit board and is also electrically connected to the main control circuit board; a vent groove is formed in the gas ballast housing and arranged in an axial direction of the gas ballast housing.

In a default state, the third vent hole in the nozzle is misaligned with the first vent hole in the gas ballast plug sleeve, such that the nozzle is disconnected from the outside, and the gas ballast assembly is in the off state; when the rotary knob is rotated, the gas ballast link will rotate synchronously, the gas ballast link, when rotating, drives the gas ballast plug sleeve to rotate, and the gas ballast plug sleeve, when rotating, drives the gas ballast plug to rotate, such that the first vent hole and the third vent hole can be aligned, the nozzle is connected to the vent groove, and dry gas enters a chamber of the second-stage pump housing from the outside along the vent groove; in the vacuumizing process of the oil pump assembly, the gas ballast assembly is turned on, a hole in the second-stage pump housing is connected to the nozzle, and gas is continuously compressed to generate water vapor in the chamber of the second-stage pump housing; dry gas is fed into the second-stage pump housing by means of the gas ballast assembly to prevent the condensation of a large amount of gas, such that the gas can enter the oil mist filter assembly with pump oil, the content of water vapor in the gas is decreased, and the generation of a large amount of oil mist is avoided, which may otherwise affect the vacuumizing efficiency. With the reduction in the quantity of oil mist, the pressure of the water vapor will be decreased, thus prolonging the service life of the vacuum pump assembly. The copper contact piece rotating synchronously with the gas ballast link is arranged on the gas ballast link, and when the gas ballast link rotates, the contact on the copper contact piece will rotate synchronously; because multiple pairs of contacts are arranged on the gas ballast circuit board, the gas ballast circuit board can generate different electric signals to allow the indicator light circuit board to display different states; when the gas ballast assembly is in the on state, the indicator light on the indicator light circuit board flickers red and blue; when the gas ballast assembly is in the off state, the indicator light is blue. In this way, users can visually learn about the on/off state of the gas ballast assembly by observing the state of the indicator light. Because the time when the gas ballast assembly is turned on is very important, users can turn on the gas ballast assembly according to actual requirements.

Preferably, a cylindrical through-hole is formed in the gas ballast link, a pair of positioning pins are arranged in the cylindrical through-hole, a limit bead is arranged at a tail end of each positioning pin and stretches and retracts synchronously with the positioning pin, and a compression spring is arranged between the two positioning pins; a plurality of limit grooves are uniformly formed in an inner wall of the mounting groove, and an outline of each limit groove matches an outline of the limit beads; the first fasteners sequentially penetrate through the gas ballast housing and the gas ballast circuit board and extend to be mounted in the mounting groove; the first vent hole and the second vent hole are arranged coaxially, and the third vent hole faces the vent groove; when the first vent hole and the third vent hole are aligned, the gas ballast assembly is in an on state; when the first vent hole and the third vent hole are misaligned, the gas ballast assembly is in an off state; a first line connecting the nozzle and the second-stage pump housing is arranged between the nozzle and the second-stage pump housing, and a snap ring for fastening the nozzle is arranged on an outer side of the nozzle.

By means of the limit beads, the positioning pins and the compression spring, the position of the rotary knob can be stably maintained, such that the gas ballast assembly can be stably maintained at a corresponding position; when the gas ballast assembly is located in an on or off position, the limit beads are clamped in the limit grooves; when the position of the gas ballast assembly needs to be switched, the rotary knob is rotated to allow the limit beads to disengage from the limit grooves, and the compression spring is further compressed; when the gas ballast assembly is switched to the corresponding position, the compression spring pushes the limit beads to be automatically clamped in the limit grooves. In a default state, the first vent hole is coaxial with the second vent hole, the third vent hole is aligned with the vent groove, and the first vent hole is misaligned with the third vent hole, such that the nozzle is in the off state, and gas cannot enter a chamber of the oil pump assembly from the outside; when the rotary knob is rotated to align the first vent hole and the third vent hole, gas enters the vent groove from a notch of the gas ballast housing, then enters the nozzle along the vent groove, and finally enters the chamber of the second-stage pump housing.

Preferably, the oil mist filter assembly further comprises second fasteners and third fasteners; the lower protective cover is arranged at the horizontal bottom of the oil tank body, and the upper protective cover covering the lower protective cover is arranged on the lower protective cover; the lower protective cover is adjacent to the elastic sheet assembly, a receiving space is defined by the upper protective cover, the lower protective cover and the horizontal bottom of the oil tank body, and the elastic sheet assembly is arranged in the receiving space; the second fasteners for fastening the upper protective cover and the lower protective cover are arranged between the upper protective cover and the lower protective cover, and the third fasteners for fastening the upper protective cover and the oil tank body are arranged between the upper protective cover and the oil tank body; oil outlets are formed in the lower protective cover, crossed barrier strips are arranged at the oil outlets, and the filter elements are arranged on the barrier strips; an outline of the filter elements matches an outline of the oil outlets, and the filter elements fit inner walls of the oil outlets.

Because the receiving space is defined by the upper protective cover, the lower protective cover and the horizontal bottom of the oil tank body, the gas and pump oil from the second-stage pump housing will first enter the receiving space and then be filtered by the filter elements, such that impurities in the gas will be left in the receiving space, oil mist will be separated out by the filter elements, the gas will become purer, and the pump oil and gas return into the chamber of the oil tank body via the oil outlets. Because the upper protective cover and the lower protective cover are detachably mounted and the oil outlets in the lower protective cover are lower than the discharge outlets, the impurities will be left on the filter elements of the lower protective cover, thus facilitating subsequent maintenance and replacement. By means of the oil mist filter assembly, the quantity of oil mist in the oil tank body is greatly reduced, and water vapor will not return into the oil pump assembly along the oil inlet tube, thus greatly improving the vacuumizing efficiency.

Preferably, the elastic sheet assembly comprises a screw, a flat washer, an elastic washer, a membrane and a sheet body; the membrane is disposed on the discharge outlets, the sheet body is mounted on the membrane, and the screw sequentially penetrates through the sheet body and the membrane and extends to be mounted in the oil tank body; the flat washer and the elastic washer are arranged on the screw, and the flat washer is adjacent to the sheet body.

The elastic sheet assembly is mounted on the discharge outlets and encompassed by the upper protective cover and the lower protective cover, such that gas and pump oil can be filtered in advance to prevent pump oil in the oil tank body from being polluted by impurities. The sheet body is elastic, the membrane abuts against top ends of the discharge outlets, and gas, after being compressed, will impact the sheet body to open the discharge outlets. The flat washer and the elastic washer are mounted on the screw, such that the sheet body can be mounted more stably and can operate for a long time.

Preferably, the condenser is arranged right below the oil tank body and comprises a plurality of condensation passages which are arranged vertically, and a horizontal passage for connecting the condensation passages is arranged at tail ends of the condensation passages; a plurality of cooling fins are uniformly arranged on outer layers of the condensation passages; the oil inlet tube is arranged in the condensation passage in a middle of the condenser, and a protective mat is arranged between the oil inlet tube and an inner wall of the condensation passage; the oil inlet tube has an end arranged at a bottom of the condensation passage as well as an end inserted into the first passage of the oil tank body; a bucket filter is arranged at a bottom of the oil inlet tube and connected to the oil inlet tube by interference fit; a partition is arranged on a side face of the oil tank body, and the gas outlet assembly is arranged at an open end of the partition; the gas outlet assembly comprises a screw connector, a sealing ring, a filter disc and a gas outlet nut; the screw connector is threadedly connected to the open end of the partition, and the gas outlet nut is threadedly connected to the screw connector; a clamping groove for mounting the sealing ring is formed in an outer wall of the screw connector, and the sealing ring is connected to the clamping groove by interference fit; the filter disc is arranged between a tail end of the screw connector and meshes of the gas outlet nut, and the filter disc fits the meshes of the gas outlet nut.

Multiple condensation passages are arranged, such that pump oil can be cooled easily; the cooling fins arranged on the outer layers of the condensation passages greatly enlarge the cooling area, such that the cooling effect is better; the protective mat is arranged in the corresponding condensation passage, such that the oil inlet tube can be fixed easily; the bucket filter is arranged at an oil inlet end of the oil inlet tube, such that pump oil entering the oil pump assembly from the oil tank body can be filtered to ensure that pump oil entering the second-stage pump housing is purer, the oil pump assembly can operate more reliably and safely, and the vacuumizing efficiency is higher. By means of the gas outlet assembly, discharged gas can be filtered easily; the meshes are formed in an end surface of the gas outlet nut, and the filter disc is arranged between the gas outlet nut and the screw connector, such that the gas can be discharged from the oil tank body to the outside in only one direction. The partition is arranged to prevent the pump oil from spilling over directly.

Preferably, the oil pump assembly further comprises a first sealing element, a second sealing element, a third sealing element and a fourth sealing element; the first sealing element is arranged between the first end cover and the pump cover, the second sealing element is arranged between the pump cover and the second-stage pump housing, the third sealing element is arranged between the second-stage pump housing and the first-stage pump housing, and the fourth sealing element is arranged between the first-stage pump housing and the second end cover; the oil pump rotor is mounted in an end groove of the short rotor, and an axial length of the long blades is greater than an axial length of the short blades; first guide grooves for mounting the first springs are formed in the long blades, and second guide grooves for mounting the second springs are formed in the short blades; the long blades are mounted on the long rotor and abut against an inner wall of the first-stage pump housing, and the short blades are mounted on the short rotor and abut against an inner wall of the second-stage pump housing; second passages connected to the oil tank body are arranged at a top of the second-stage pump housing and are coaxial with the discharge outlets; a fan blade rotating synchronously with the motor assembly is arranged at an end, facing away from the oil pump assembly, of the motor assembly, and a heat sink is arranged at a bottom of the shell.

By means of the first sealing element, the second sealing element, the third sealing element and the fourth sealing element, the sealing performance of the oil pump assembly is improved; by means of the first guide grooves, the first springs can be mounted easily, and the long blades can cling to the inner wall of the first-stage pump housing; by means of the second guide grooves, the second springs can be mounted easily, and the short blades can cling to the inner wall of the second-stage pump housing; the fan blade is arranged, faces the condenser and works synchronously with the condenser, such that the cooling effect on the vacuum pump assembly is better. Moreover, the heat sink is arranged at the bottom of the shell and located below the vacuum pump assembly, such that the cooling effect is further improved.

Preferably, the gas inlet assembly comprises a gas inlet connector, and gas inlets with different diameters are formed in the gas inlet connector; a threaded protective sleeve is arranged at each gas inlet, and fifth sealing elements, diameters of which correspond to the diameters of the gas inlets, are arranged at the gas inlets; a gas inlet cover plate for fastening the gas inlet connector and the shell is arranged between the gas inlet connector and the shell, a bent tube for connecting the gas inlet connector and a second end cover is arranged between the gas inlet connector and the second end cover, and an anti-backflow ball is arranged at an end, facing the second end cover, of the bent tube.

The gas inlets with different diameters can be connected to lines with different thicknesses; the threaded protective sleeves can prevent impurities from falling into the gas inlets; the anti-backflow ball is arranged in the bent tube, and when the motor assembly of the vacuum pump assembly stops, the pressure in an external container is low, so the anti-backflow ball blocks the bent tube to prevent pump oil from flowing back into the external container.

Compared with the prior art, the invention has the following beneficial effects: the oil mist filter assembly is arranged in the oil tank body to filter gas and pump oil flowing out of the oil pump assembly, such that impurities in the gas are prevented from entering the oil tank body, which may otherwise pollute the pump oil; oil mist is separated out by the filter elements in the oil mist filter assembly, such that the generation of a large quantity of oil mist in the oil tank body is avoided, and the quantity of water vapor flowing back into the oil pump assembly is reduced; the gas ballast assembly can be turned on and off easily by means of the rotary knob on the gas ballast assembly, and when the gas ballast assembly is turned on, dry gas enters the oil pump assembly from the outside to prevent the condensation of a large quantity of gas, such that the content of water vapor in the gas is reduced, and the generation of a large quantity of oil mist in the oil tank body is avoided; moreover, the gas is further filtered by the gas outlet assembly, such that the gas discharged to the outside is purer, and the environmental friendliness is better. In addition, the operating state of the indicator light circuit board can be directly observed by means of the sight glass on the side face of the oil tank body to learn about the operating state of the gas ballast assembly at any time, such that using is convenient and safe. Because the oil tank body is arranged externally, the motor assembly is isolated from pump oil, and heat generated when the temperature of the pump oil rises will not be transferred to the motor assembly, thus effectively prolonging the operating time of equipment. The fan blade and the condenser work together to ensure that the vacuum pump assembly always operates at a low temperature, and the temperature of pump oil is effectively controlled, such that the operating time of equipment is prolonged. In conclusion, the oil mist filter assembly and the gas ballast assembly can work together to greatly reduce the quantity of generated oil mist, improve the vacuumizing efficiency of the vacuum pump and maintain a long operating time of equipment.

Reference signs in the FIGS.: 1, shell; 2, vacuum pump assembly; 21, motor assembly; 3, oil tank assembly; 31, oil tank body; 32, discharge outlet; 33, first passage; 34, oil guard; 35, oil tank cap; 36, socket; 37, mounting hole; 38, partition; 4, oil pump assembly; 41, pump cover; 42, first-stage pump housing; 43, second-stage pump housing; 44, first end cover; 45, second end cover; 46, long rotor; 47, long blade; 48, short rotor; 49, short blade; 410, oil pump rotor; 411, first spring; 412, second spring; 413, first sealing element; 414, second sealing element; 415, third sealing element; 416, fourth sealing element; 417, first guide groove; 418, second guide groove; 419, second passage; 5, condenser; 51, condensation passage; 52, horizontal passage; 53, cooling fin; 54, protective mat; 6, oil mist filter assembly; 61, upper protective cover; 62, lower protective cover; 63, filter element; 64, second fastener; 65, third fastener; 66, oil outlet; 67, barrier strip; 7, elastic sheet assembly; 71, screw; 72, flat washer; 73, elastic washer; 74, membrane; 75, sheet body; 8, gas ballast assembly; 81, rotary knob; 82, nozzle; 83, gas ballast link; 84, copper contact piece; 85, gas ballast circuit board; 86, gas ballast plug sleeve; 87, gas ballast plug; 88, gas ballast housing; 89 first vent hole; 810, second vent hole; 811, third vent hole; 812, vent groove; 813, cylindrical through-hole; 814, positioning pin; 815, limit bead; 816, compression spring; 817, snap ring; 818, first line; 9, gas inlet assembly; 91, gas inlet connector; 92, gas inlet; 93, threaded protective sleeve; 94, fifth sealing element; 95, gas inlet cover plate; 96, bent tube; 97, anti-backflow ball; 10, gas outlet assembly; 101, screw connector; 102, sealing ring; 103, filter disc; 104, gas outlet nut; 105, clamping groove; 11, oil inlet tube; 111, bucket filter; 12, indicator light circuit board; 13, main control circuit board; 14, sight glass; 15, stationary press plate; 16, sealing strip; 17, mounting groove; 18, first fastener; 19, limit groove; 20, fan blade; 23, heat sink.

DETAILED DESCRIPTION OF THE EMBODIMENTS

The invention is further described below in conjunction with embodiments illustrated by accompanying drawings.

Figure 1:
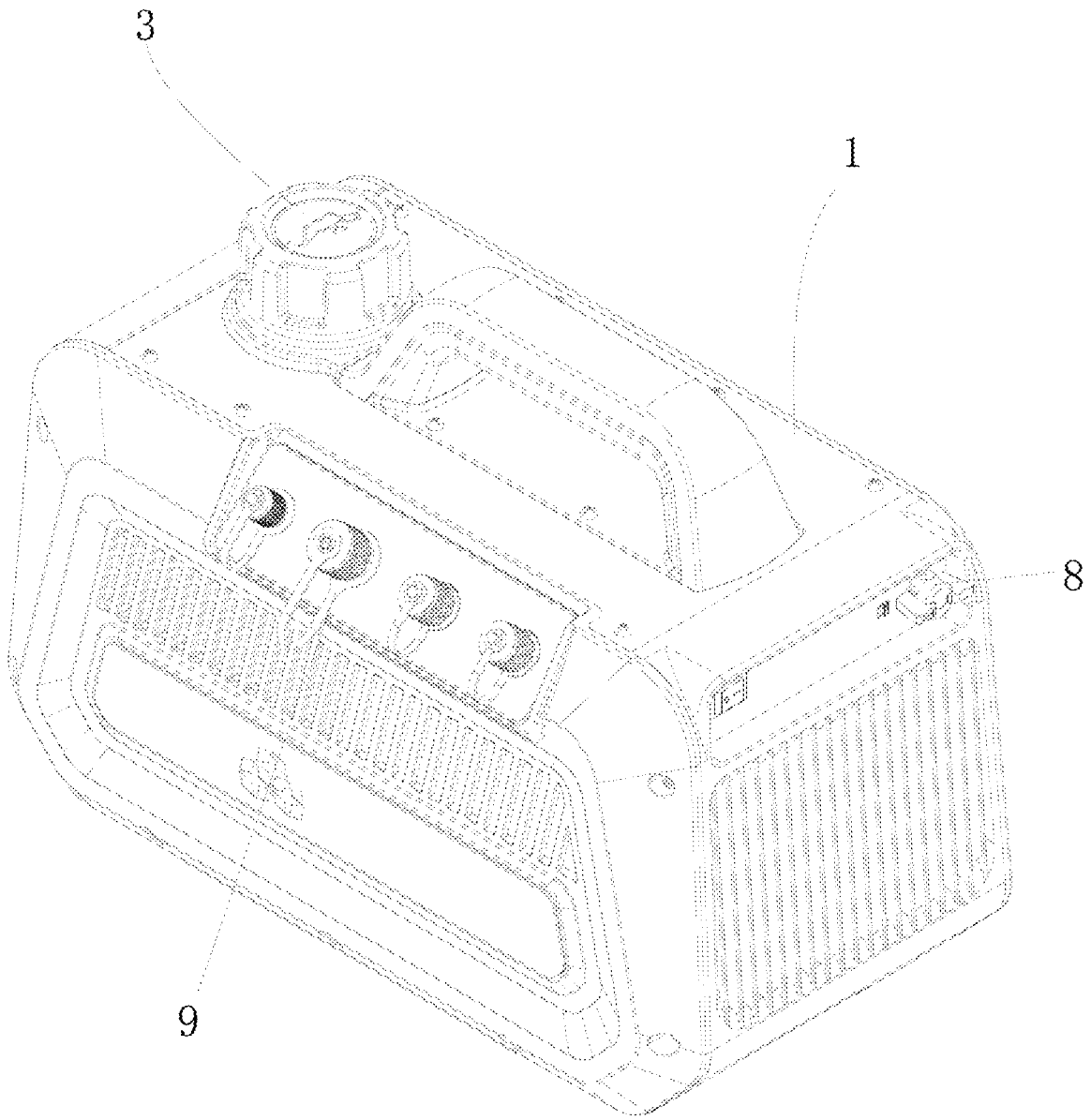
FIG. 1 is a stereogram according to the invention.
Figure 2:
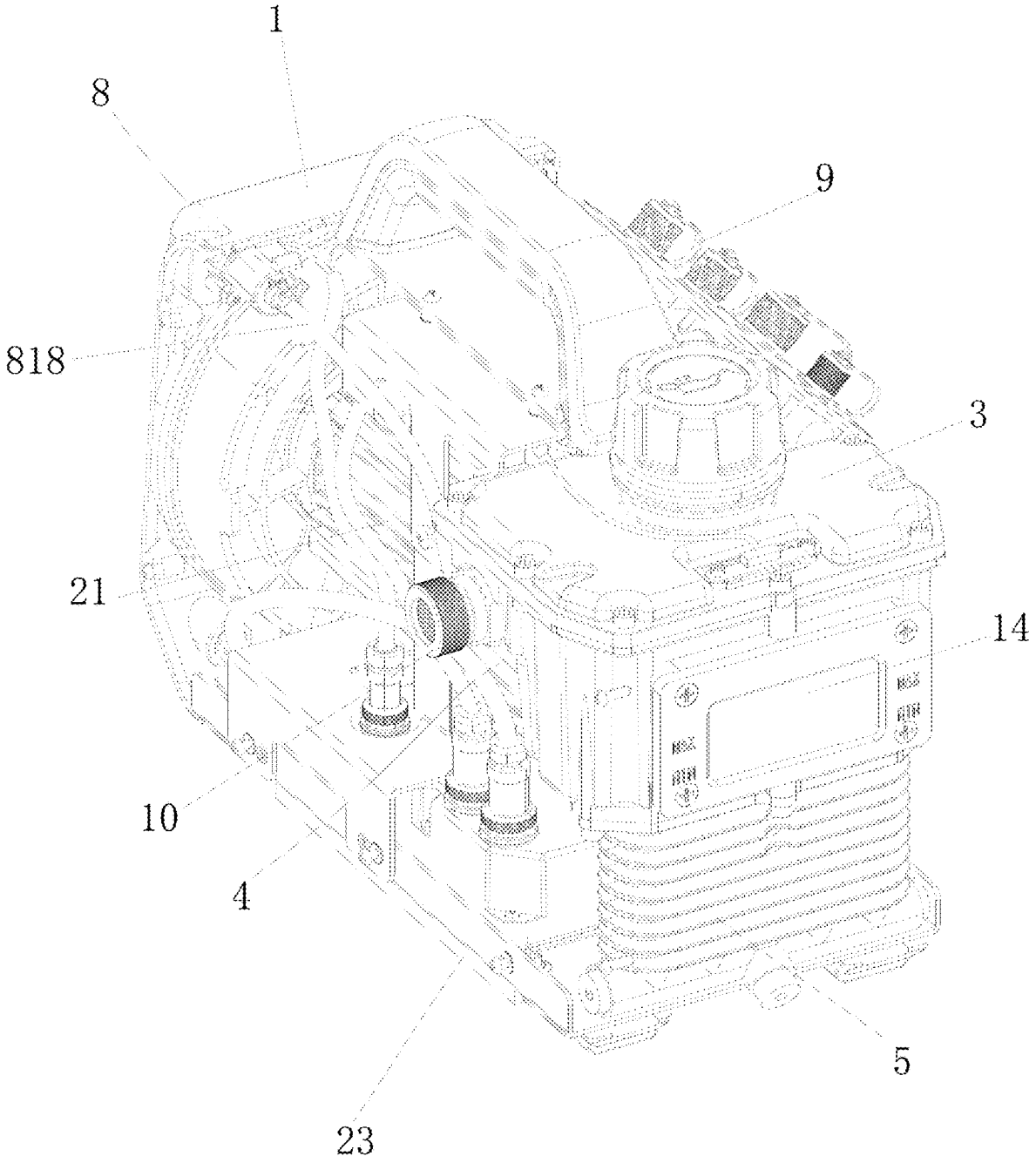
FIG. 2 is a stereogram in a case where part of a shell is hidden according to the invention.
Figure 3:
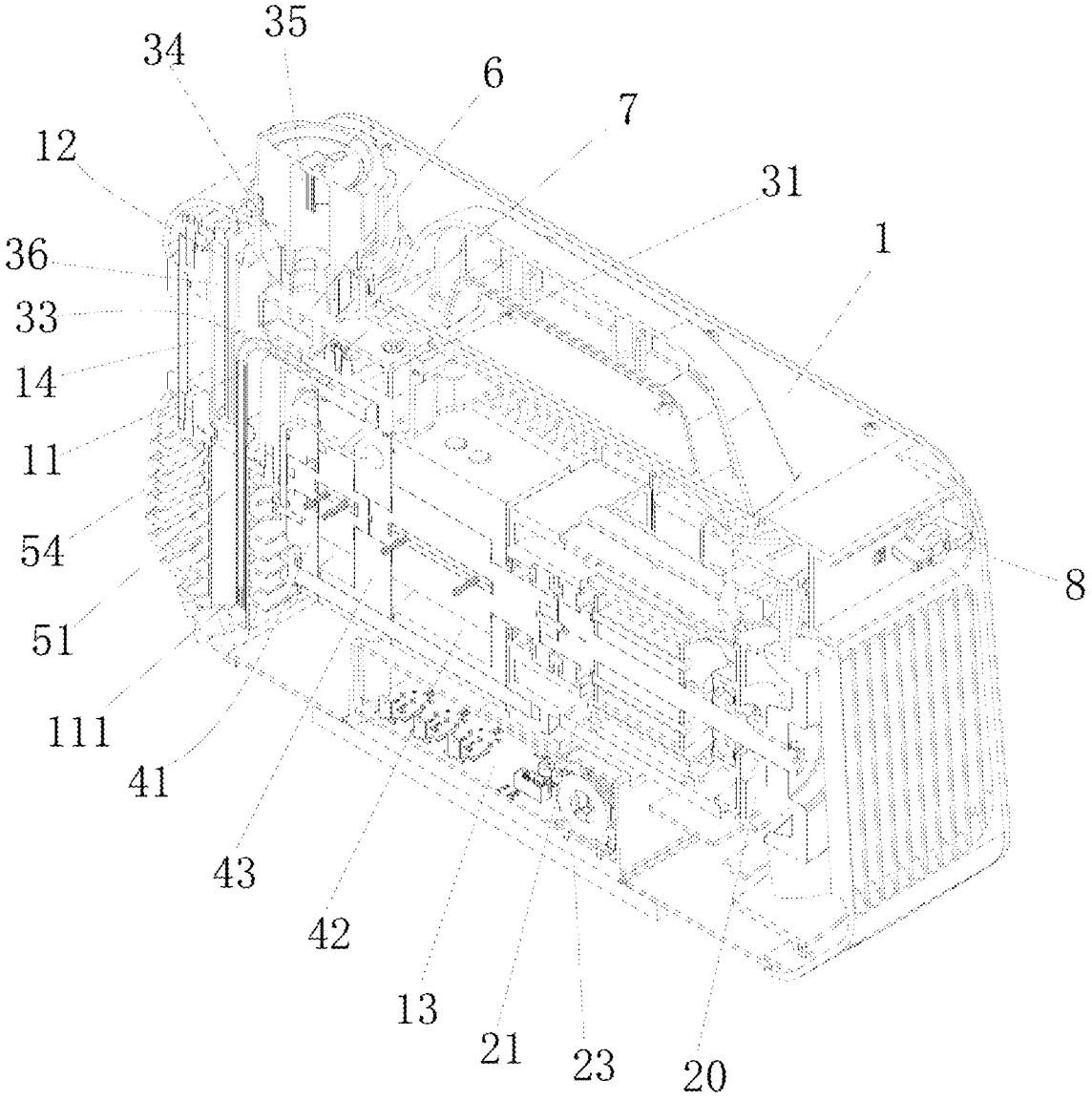
FIG. 3 is an internal structural view according to the invention.
Figure 4:
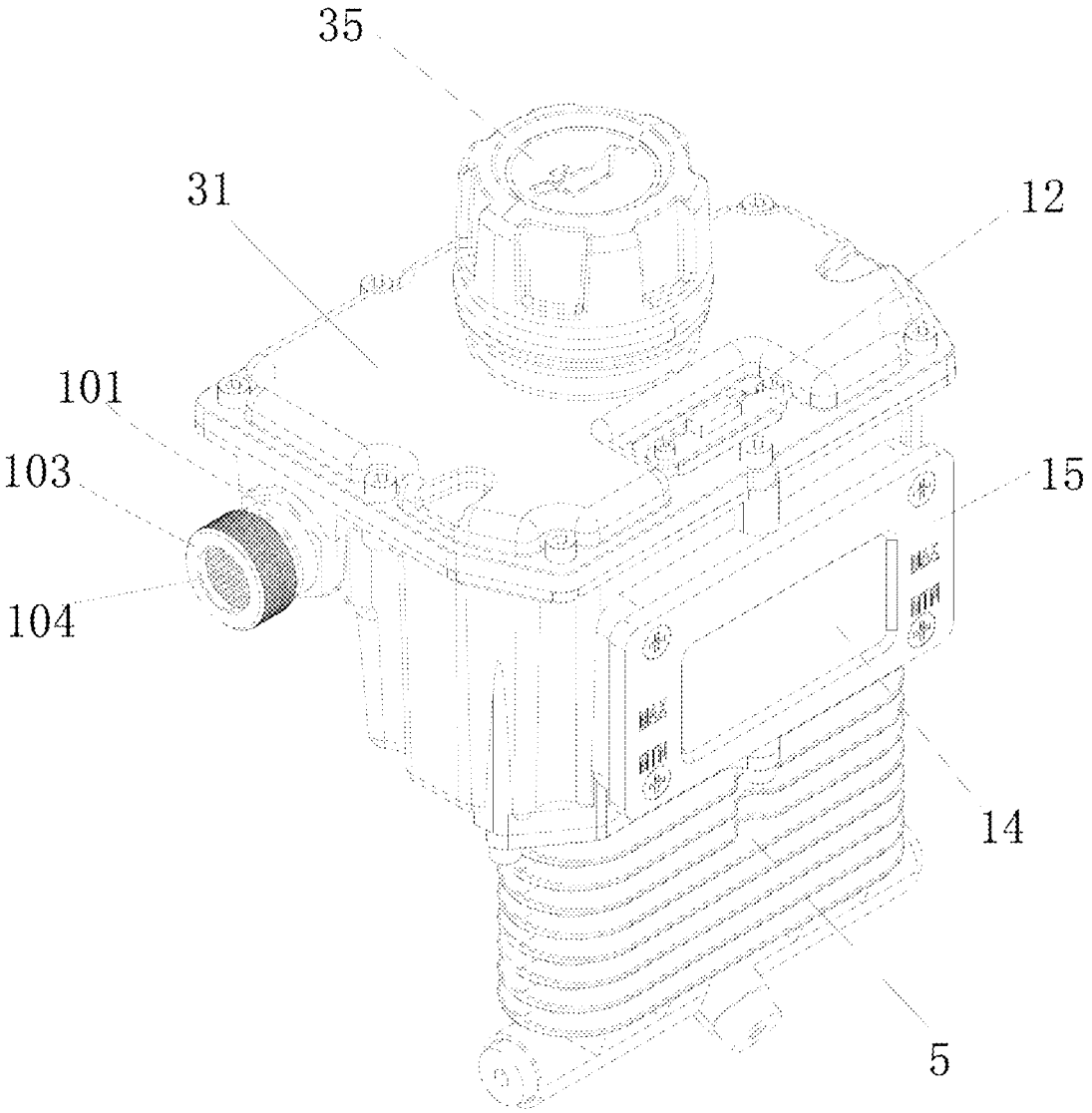
FIG. 4 is a stereogram of an oil tank assembly and a condenser during assembly.
Figure 5:
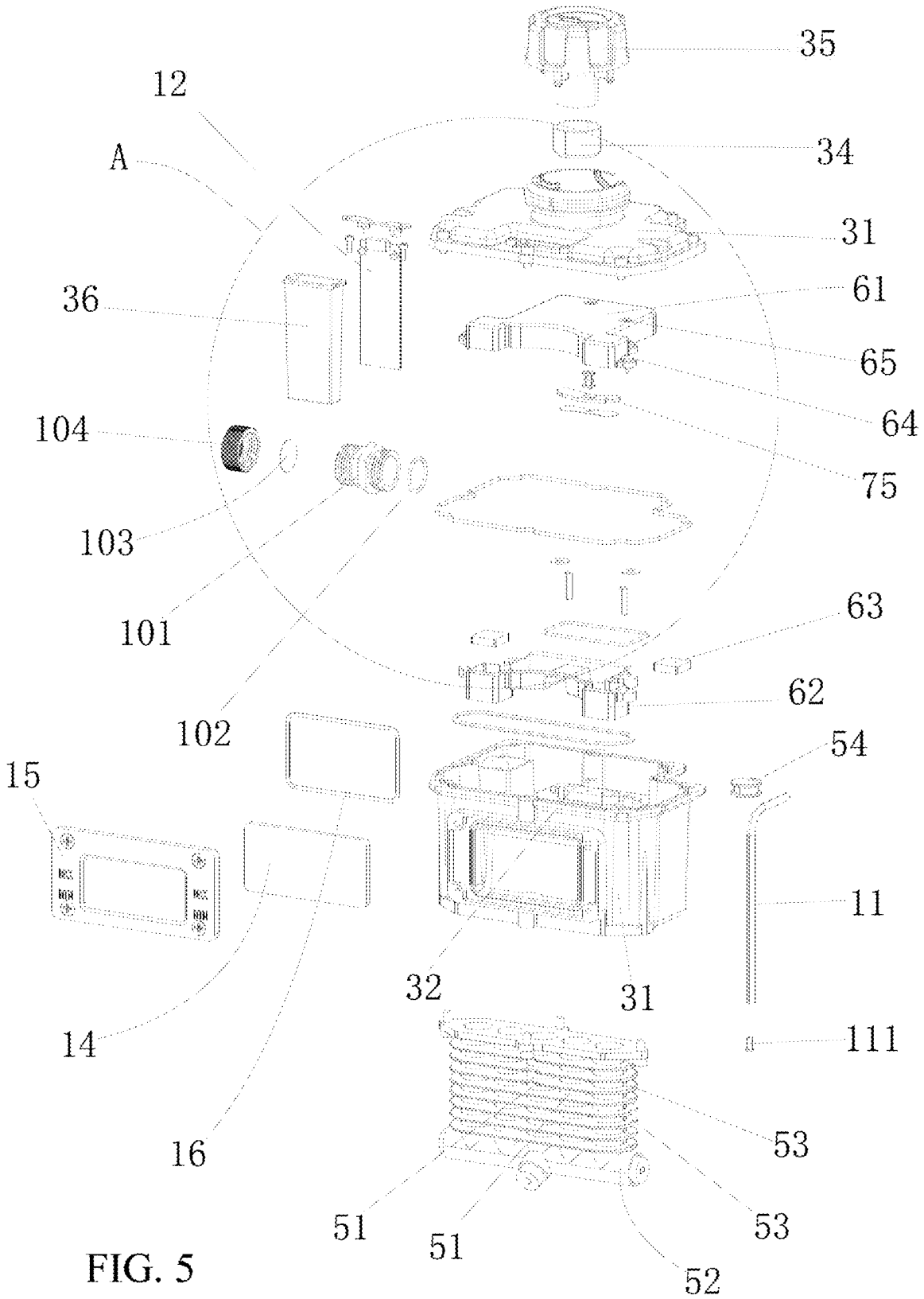
FIG. 5 is an exploded view of the oil tank assembly and the condenser in FIG. 4.
Figure 6:
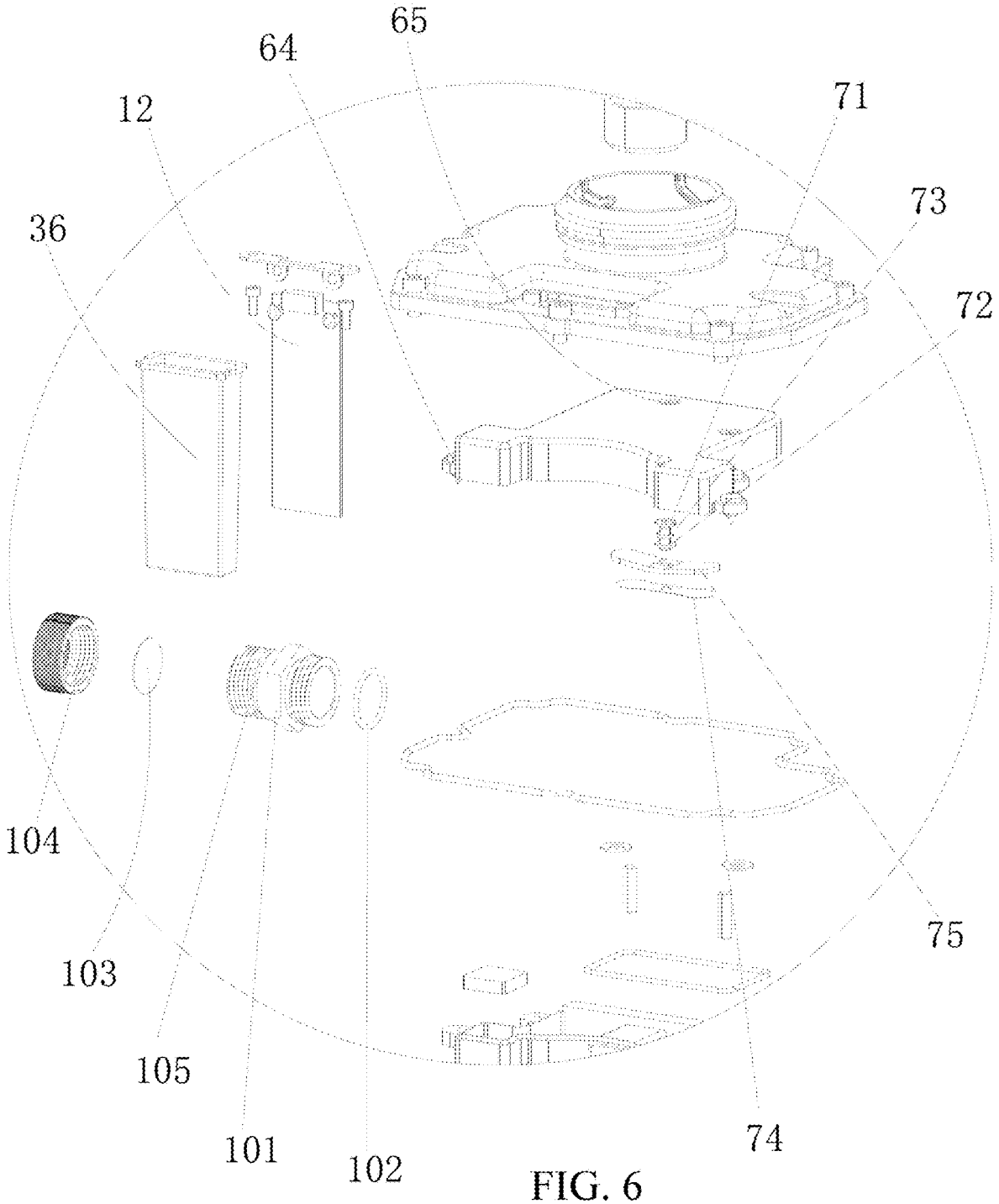
FIG. 6 is an enlarged view of part A in FIG. 5.
Figure 7:
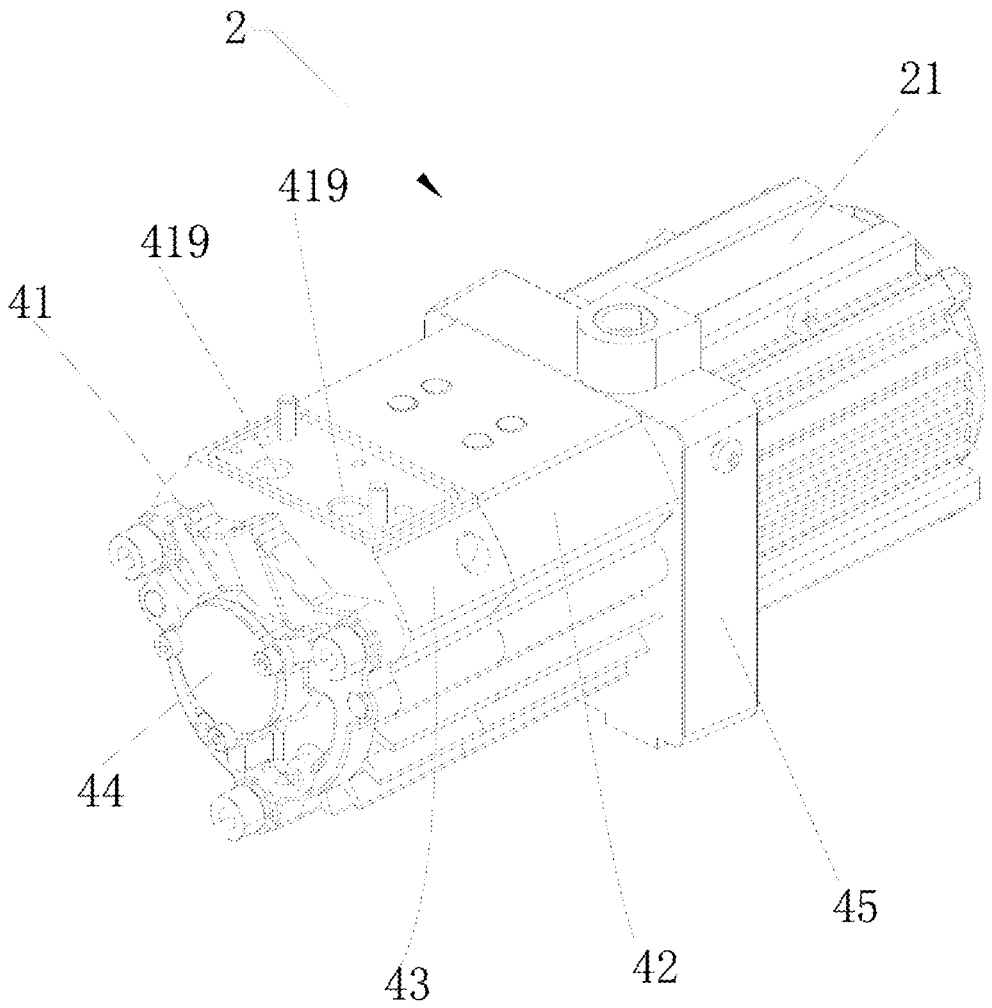
FIG. 7 is a stereogram of a vacuum pump assembly.
Figure 8:
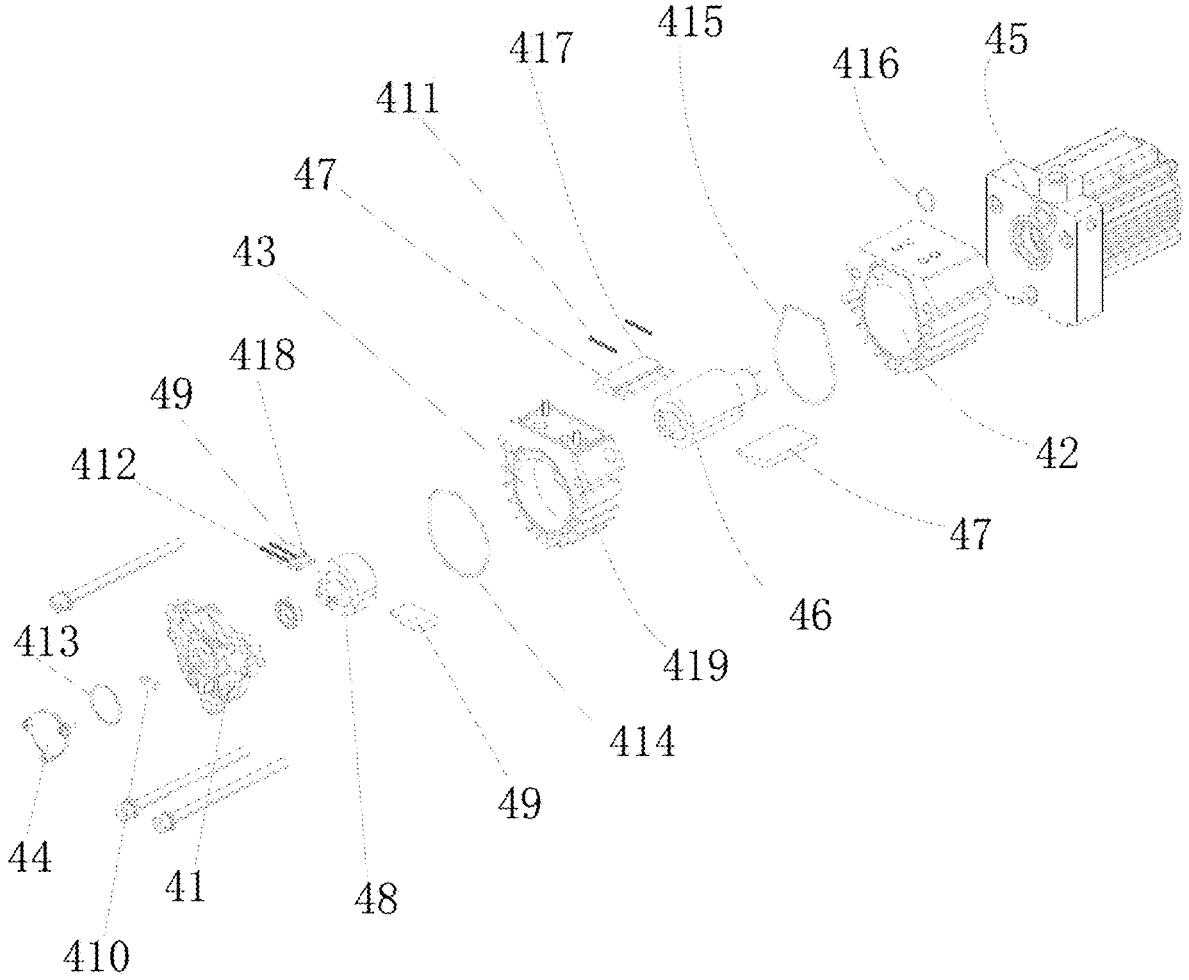
FIG. 8 is an exploded view of the vacuum pump assembly.
Figure 9:
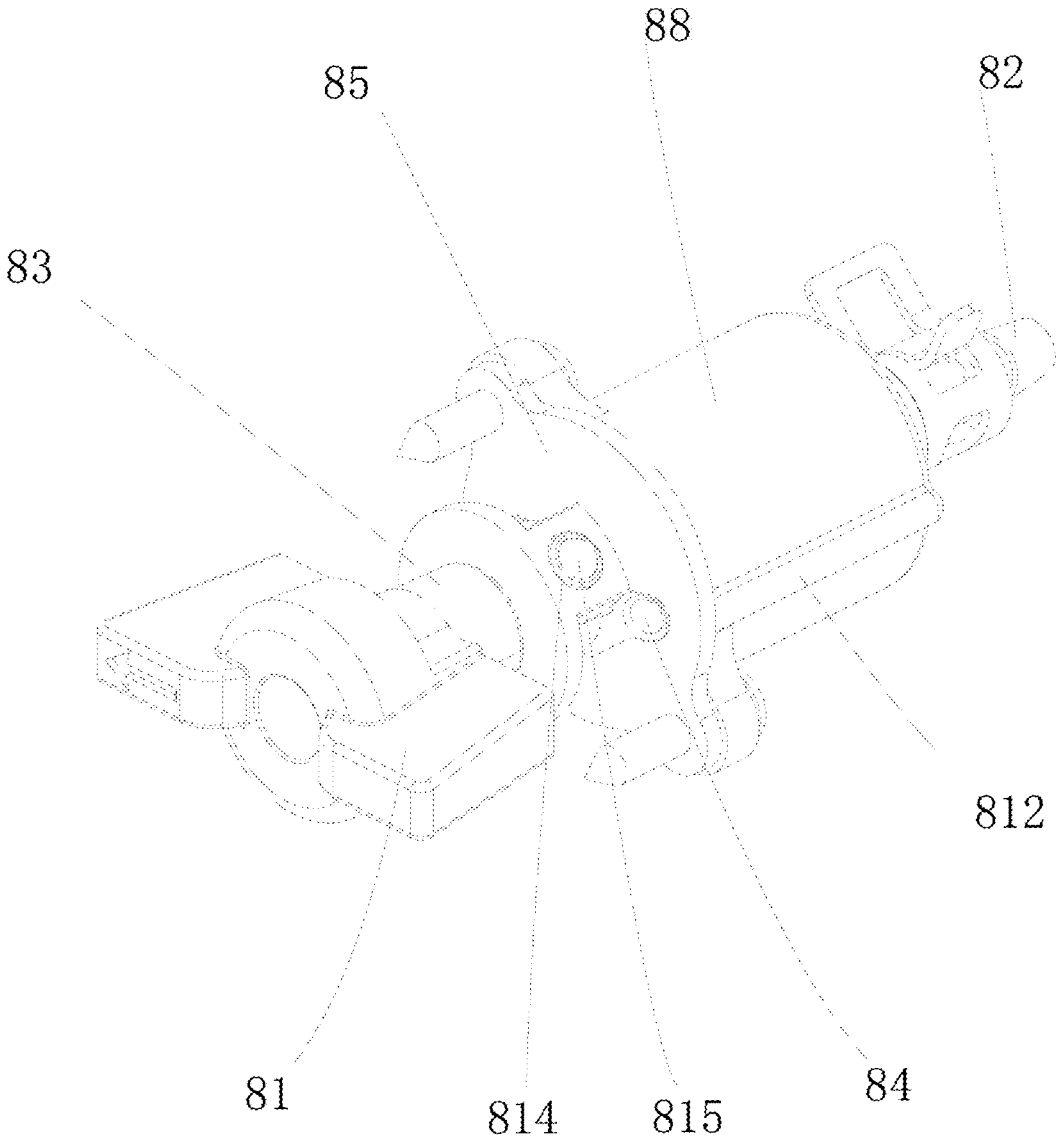
FIG. 9 is a stereogram of a gas ballast assembly.
Figure 10:
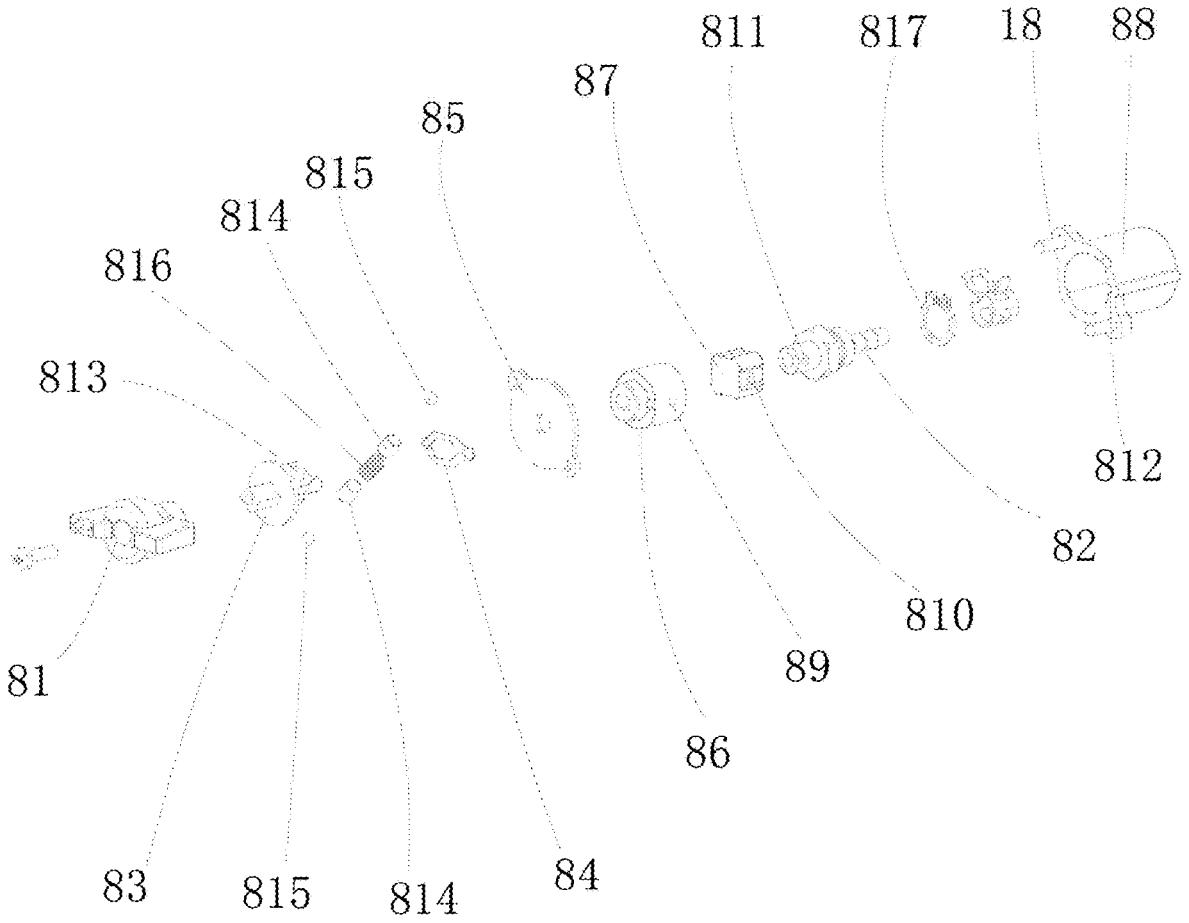
FIG. 10 is an exploded view of the gas ballast assembly.
Figure 11:
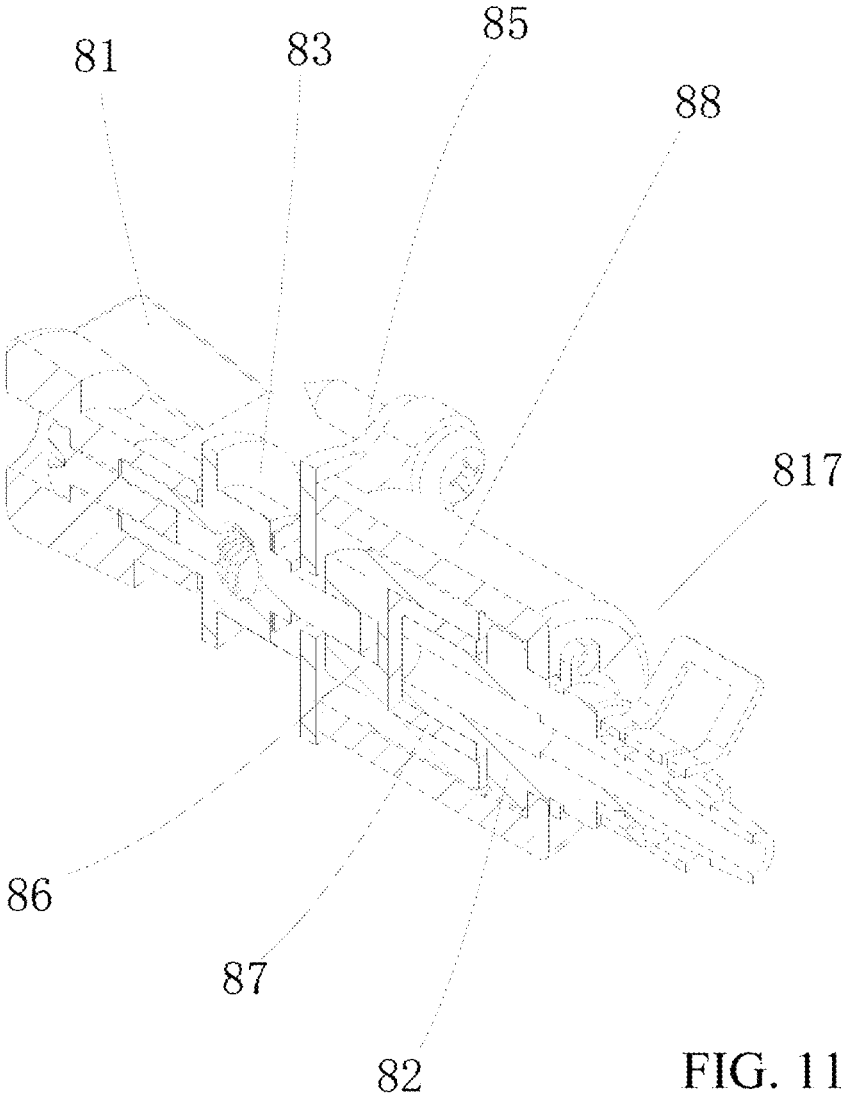
FIG. 11 is an internal structural view of the gas ballast assembly.
Figure 12:
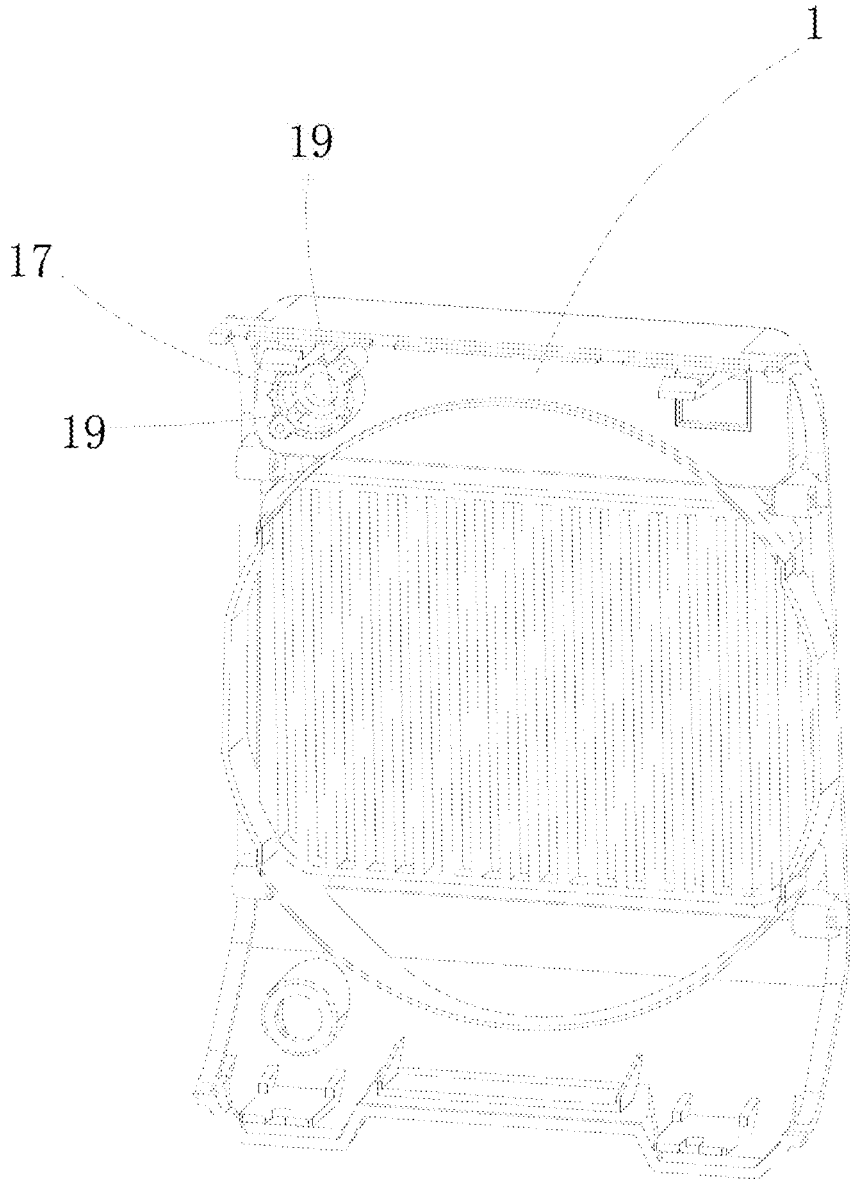
FIG. 12 is an internal structural view of the shell.
Figure 13:
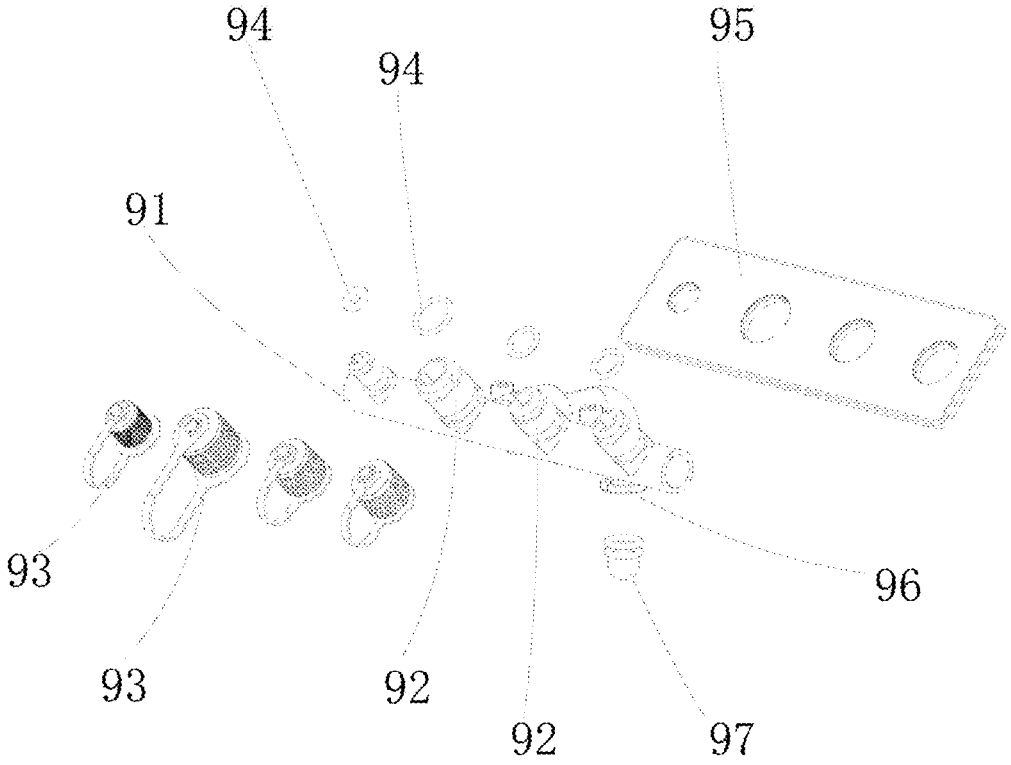
FIG. 13 is an exploded view of a gas inlet assembly.
Figure 14:
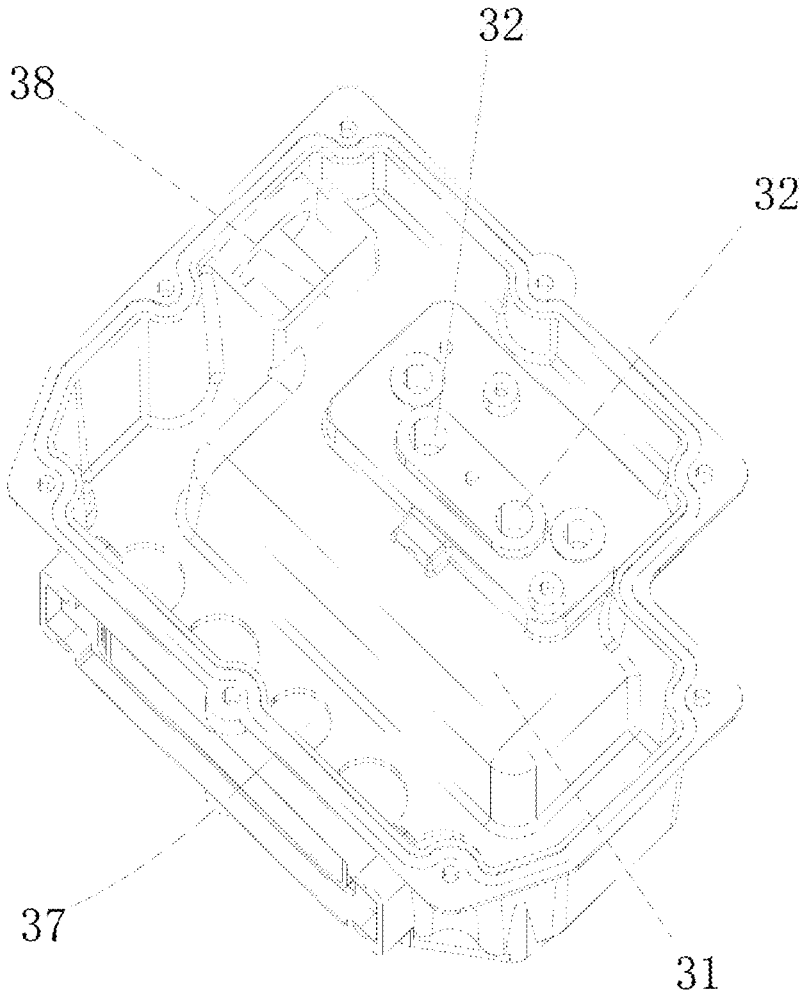
FIG. 14 is an internal structural view of an oil tank body.
Figure 15:
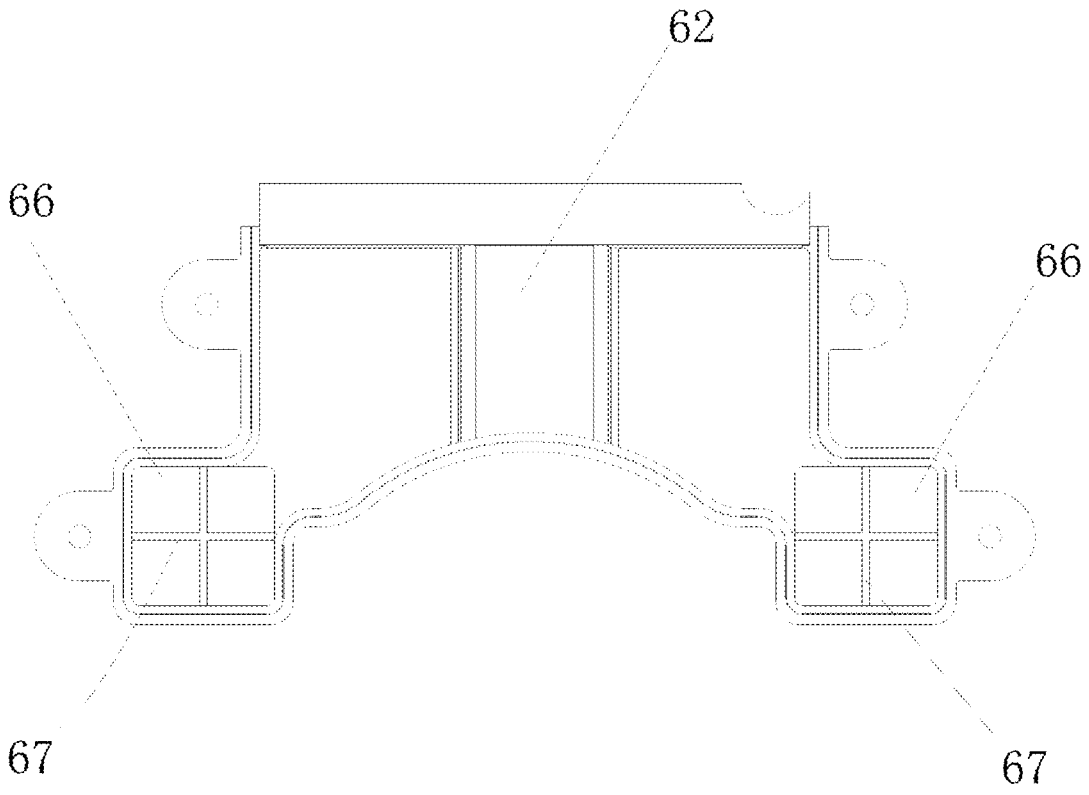
FIG. 15 is a top view of a lower protective cover.

As shown in FIGS. 1-15, this embodiment provides a multifunctional vacuum pump, comprising a shell 1, wherein a vacuum pump assembly 2 and an oil tank assembly 3 are arranged in the shell 1, the vacuum pump assembly 2 comprises an oil pump assembly 4 and a motor assembly 21, a condenser 5 connected to the oil tank assembly 3 is arranged below the oil tank assembly 3, and an oil inlet tube 11 connecting the condenser 5 and the oil pump assembly 4 is arranged between the condenser 5 and the oil pump assembly 4; the oil tank assembly 3 comprises an oil tank body 31, and discharge outlets 32 are formed in the oil tank body 31 and connected to the oil pump assembly 4; an oil mist filter assembly 6 is arranged above the discharge outlets 32 and comprises an upper protective cover 61, a lower protective cover 62 and filter elements 63; an elastic sheet assembly 7 for controlling the discharge outlets 32 to be opened or closed is arranged between the discharge outlets 32 and the upper protective cover 61; a gas ballast assembly 8 connected to the oil pump assembly 4 is arranged on the shell 1 and comprises a rotary knob 81 and a nozzle 82, and when the rotary knob 81 is rotated with respect to the shell 1, the nozzle 82 is in an on or off state; a gas inlet assembly 9 connected to the oil pump assembly 4 is arranged on the shell 1, and a gas outlet assembly 10 is arranged on a side face of the oil tank body 31.

The oil pump assembly 4 comprises a pump cover 41, a first-stage pump housing 42, a second-stage pump housing 43, a first end cover 44 and a second end cover 45, wherein the first end cover 44 is connected to the pump cover 41, the pump cover 41 is connected to the second-stage pump housing 43, the second-stage pump housing 43 is connected to the first-stage pump housing 42, the first-stage pump housing 42 is connected to the second end cover 45, and the second end cover 45 is connected to the motor assembly 21; a long rotor 47 and a pair of long blades 47 are arranged in the first-stage pump housing 42, and a short rotor 48 and a pair of short blades 49 are arranged in the second-stage pump housing 43; an oil pump rotor 410 rotating synchronously with the short rotor 48 is arranged on the short rotor 48, the short rotor 48 and the long rotor 46 rotate synchronously, and the long rotor 46 and the motor assembly 21 rotate synchronously; first springs 411 are arranged between the two long blades 47, and second springs 412 are arranged between the two short blades 49; the second-stage pump housing 43 is connected to the oil tank body 31, and a first passage 33 connecting the second-stage pump housing 43 and the oil inlet tube 11 is arranged in the oil tank body 31; the second-stage pump housing 43 is connected to the gas ballast assembly 8, and the second end cover 45 is connected to the gas inlet assembly 9. The oil tank assembly 3 is arranged above the oil pump assembly 4 and further comprises an oil guard 34 and an oil tank cap 35; the oil guard 34 is arranged at an open end of the oil tank body 31, and the oil tank cap 35 is threadedly connected to the oil tank body 31; a socket 36 extending vertically is arranged on an end cover of the oil tank body 31, and an indicator light circuit board 12 is arranged in the socket 36; a main control circuit board 13 is arranged below the oil pump assembly 4, the indicator light circuit board 12 is electrically connected to the gas ballast assembly 8, and the gas ballast assembly 8 is electrically connected to the main control circuit board 13; the discharge outlets 32 are arranged in a chamber of the oil tank body 31 side-by-side, the elastic sheet assembly 7 is arranged on the discharge outlets 32, and the oil mist filter assembly 6 fitting the oil tank body 31 is arranged above the elastic sheet assembly 7; a plurality of mounting holes 37 are uniformly formed in the bottom of the oil tank body 31, and the condenser 5 is arranged below the mounting holes 37; a sight glass 14 is arranged on an end surface, facing the socket 36, of the oil tank body 31, a stationary press plate 15 connected to the oil tank body 31 is arranged on an outer side of the sight glass 14, and a sealing strip 16 is arranged between the sight glass 14 and the oil tank body 31; the gas outlet assembly 10 is arranged on an outer wall of the oil tank body 31.

The gas ballast assembly 8 comprises the rotary knob 81, the nozzle 82, a gas ballast link 83, a copper contact piece 84, a gas ballast circuit board 85, a gas ballast plug sleeve 86, a gas ballast plug 87 and a gas ballast housing 88; the gas ballast link 83 and the rotary knob 81 are mounted on two sides of the shell 1 respectively; a mounting groove 17 for mounting the gas ballast link 83 is formed in the shell 1, and the gas ballast link 83 and the gas ballast plug sleeve 86 are connected and rotate synchronously; the gas ballast plug 87 rotating synchronously with the gas ballast plug sleeve 86 is arranged in the gas ballast plug sleeve 86 and disposed around the nozzle 82; the gas ballast housing 88 is disposed around an outer layer of the gas ballast plug sleeve 86, and the gas ballast plug sleeve 86 is able to rotate with respect to the gas ballast housing 88; the gas ballast circuit board 85 is arranged between a head end of the gas ballast housing 88 and the mounting groove 17, and first fasteners 18 are arranged between the gas ballast housing 88 and the mounting groove 17; the copper contact piece 84 is mounted on the gas ballast link 83 and rotates synchronously with the gas ballast link 83, and a contact on the copper contact piece 84 faces contacts on the gas ballast circuit board 85; a first vent hole 89 is formed in the gas ballast plug sleeve 86, a second vent hole 810 is formed in the gas ballast plug 87, and a third vent hole 811 is formed in the nozzle 82; the gas ballast circuit board 85 is electrically connected to the indicator light circuit board 12 and is also electrically connected to the main control circuit board 13; a vent groove 812 is formed in the gas ballast housing 88 and arranged in an axial direction of the gas ballast housing 88. A cylindrical through-hole 813 is formed in the gas ballast link 83, a pair of positioning pins 814 are arranged in the cylindrical through-hole 813, a limit bead 815 is arranged at a tail end of each positioning pin 814 and stretches and retracts synchronously with the positioning pin 814, and a compression spring 816 is arranged between the two positioning pins 814; a plurality of limit grooves 19 are uniformly formed in an inner wall of the mounting groove 17, and the outline of each limit groove 19 matches the outline of the limit beads 815; the first fasteners 18 sequentially penetrate through the gas ballast housing 88 and the gas ballast circuit board 85 and extend to be mounted in the mounting groove 17; the first vent hole 89 and the second vent hole 810 are arranged coaxially, and the third vent hole 811 faces the vent groove 812; when the first vent hole 89 and the third vent hole 811 are aligned, the gas ballast assembly 8 is in an on state; when the first vent hole 89 and the third vent hole 811 are misaligned, the gas ballast assembly 8 is in an off state; a first line 818 connecting the nozzle 82 and the second-stage pump housing 43 is arranged between the nozzle 82 and the second-stage pump housing 43, and a snap ring 817 for fastening the nozzle 82 is arranged on an outer side of the nozzle 82.

The oil mist filter assembly 6 further comprises second fasteners 64 and third fasteners 65; the lower protective cover 62 is arranged at the horizontal bottom of the oil tank body 31, and the upper protective cover 61 covering the lower protective cover 62 is arranged on the lower protective cover 62; the lower protective cover 62 is adjacent to the elastic sheet assembly 7, a receiving space is defined by the upper protective cover 61, the lower protective cover 62 and the horizontal bottom of the oil tank body 31, and the elastic sheet assembly 7 is arranged in the receiving space; the second fasteners 64 for fastening the upper protective cover 61 and the lower protective cover 62 are arranged between the upper protective cover 61 and the lower protective cover 62, and the third fasteners 65 for fastening the upper protective cover 61 and the oil tank body 31 are arranged between the upper protective cover 61 and the oil tank body 31; oil outlets 66 are formed in the lower protective cover 62, crossed barrier strips 67 are arranged at the oil outlets 66, and the filter elements 63 are arranged on the barrier strips 67; the outline of the filter elements 63 matches the outline of the oil outlets 66, and the filter elements 63 fit inner walls of the oil outlets 66. The elastic sheet assembly 7 comprises a screw 71, a flat washer 72, an elastic washer 73, a membrane 74 and a sheet body 75; the membrane 74 is disposed on the discharge outlets 32, the sheet body 75 is mounted on the membrane 74, and the screw 71 sequentially penetrates through the sheet body 75 and the membrane 74 and extends to be mounted in the oil tank body 31; the flat washer 72 and the elastic washer 73 are arranged on the screw 71, and the flat washer 72 is adjacent to the sheet body 75.

The condenser 5 is arranged right below the oil tank body 31 and comprises a plurality of condensation passages 51 which are arranged vertically, and a horizontal passage 52 for connecting the condensation passages 51 is arranged at tail ends of the condensation passages 51; a plurality of cooling fins 53 are uniformly arranged on outer layers of the condensation passages 51; the oil inlet tube 11 is arranged in the condensation passage 51 in the middle of the condenser 5, and a protective mat 54 is arranged between the oil inlet tube 11 and an inner wall of the condensation passage 51; one end of the oil inlet tube 11 is arranged at the bottom of the condensation passage 51, and the other end of the oil inlet tube 11 is inserted into the first passage 33 of the oil tank body 31; a bucket filter 111 is arranged at the bottom of the oil inlet tube 11 and connected to the oil inlet tube 11 by interference fit; a partition 38 is arranged on a side face of the oil tank body 31, and the gas outlet assembly 10 is arranged at an open end of the partition 38; the gas outlet assembly 10 comprises a screw connector 101, a sealing ring 102, a filter disc 103 and a gas outlet nut 104; the screw connector 101 is threadedly connected to the open end of the partition 38, and the gas outlet nut 103 is threadedly connected to the screw connector 101; a clamping groove 105 for mounting the sealing ring 102 is formed in an outer wall of the screw connector 101, and the sealing ring 102 is connected to the clamping groove 105 by interference fit; the filter disc 103 is arranged between a tail end of the screw connector 101 and meshes of the gas outlet nut 104, and the filter disc 103 fits the meshes of the gas outlet nut 104. The oil pump assembly 4 further comprises a first sealing element 413, a second sealing element 414, a third sealing element 415 and a fourth sealing element 416; the first sealing element 413 is arranged between the first end cover 44 and the pump cover 41, the second sealing element 414 is arranged between the pump cover 41 and the second-stage pump housing 43, the third sealing element 415 is arranged between the second-stage pump housing 43 and the first-stage pump housing 42, and the fourth sealing element 416 is arranged between the first-stage pump housing 42 and the second end cover 45; the oil pump rotor 410 is mounted in an end groove of the short rotor 48, and an axial length of the long blades 47 is greater than an axial length of the short blades 49; first guide grooves 417 for mounting the first springs 411 are formed in the long blades 47, and second guide grooves 418 for mounting the second springs 412 are formed in the short blades 49; the long blades 47 are mounted on the long rotor 46 and abut against an inner wall of the first-stage pump housing 42, and the short blades 49 are mounted on the short rotor 48 and abut against an inner wall of the second-stage pump housing 43; second passages 419 connected to the oil tank body 31 are arranged at the top of the second-stage pump housing 43 and are coaxial with the discharge outlets 32; a fan blade 20 rotating synchronously with the motor assembly 21 is arranged at an end, facing away from the oil pump assembly 4, of the motor assembly 21, and a heat sink 23 is arranged at the bottom of the shell 1. The gas inlet assembly 9 comprises a gas inlet connector 91, and gas inlets 92 with different diameters are formed in the gas inlet connector 91; a threaded protective sleeve 93 is arranged at each gas inlet 92, and fifth sealing elements 94, diameters of which correspond to the diameters of the gas inlets 92, are arranged at the gas inlets 92; a gas inlet cover plate 95 for fastening the gas inlet connector 91 and the shell 1 is arranged between the gas inlet connector 91 and the shell 1, a bent tube 96 for connecting the gas inlet connector 91 and the second end cover 45 is arranged between the gas inlet connector 91 and the second end cover 45, and an anti-backflow ball 97 is arranged at an end, facing the second end cover 45, of the bent tube 96.

The specific operating process of this embodiment is as follows: when vacuumizing is needed, a container is connected to the gas inlets 92 of the gas inlet assembly 9 by means of an external line; then, a power switch is turned on, the motor assembly 21 operates to drive the long rotor 46 to rotate, the long rotor 46, when rotating, drives the short rotor 48 to rotate, and the short rotor 48, when rotating, drives the oil pump rotor 410 to rotate synchronously, such that the long blades 47 rotate in the first-stage pump housing 42, and the short blades 49 rotate in the second-stage pump housing 43; gas enters the first-stage pump housing 42 first by means of the second end cover 45, and when the long blades 47 rotate continuously, the gas in the first-stage pump housing 42 will be compressed; then, the gas enters the second-stage pump housing 43, and when the short blades 49 rotate continuously, the gas in the second-stage pump housing 43 will be compressed. After that, the gas enters the oil tank body 31 from the second-stage pump housing 43 along the discharge outlets 32, and then, the gas and pump oil are filtered by the oil mist filter assembly 6. Because the receiving space is defined by the upper protective cover 61, the lower protective cover 62 and the horizontal bottom of the oil tank body 31, the gas and pump oil from the second-stage pump housing 43 will first enter the receiving space and then be filtered by the filter elements 63, such that impurities in the gas will be left in the receiving space, oil mist will be separated out by the filter elements 63, the gas will become purer, and the pump oil and gas return into the chamber of the oil tank body 31 via the oil outlets 66. Because the upper protective cover 61 and the lower protective cover 62 are detachably mounted and the oil outlets 66 in the lower protective cover 62 are lower than the discharge outlets 32, the impurities will be left on the filter elements 63 of the lower protective cover 62, thus facilitating subsequent maintenance and replacement. By means of the oil mist filter assembly 6, the quantity of oil mist in the oil tank body 31 is greatly reduced, and water vapor will not return into the oil pump assembly 4 along the oil inlet tube 11, thus greatly improving the vacuumizing efficiency. The condenser 5 will cyclically cool the pump oil, and the protective mat 54 is arranged in the corresponding condensation passage 51 to fix the oil inlet tube 11; the bucket filter 111 is mounted at an oil inlet end of the oil inlet tube 11, such that pump oil entering the oil pump assembly 4 from the oil tank body 31 can be filtered to ensure that pump oil entering the second-stage pump housing 43 is purer, the oil pump assembly can operate more reliably and safely, and the vacuumizing efficiency is higher. Here, the pump oil returns into the second-stage pump housing 43 by means of the oil inlet tube 11 and then flows cyclically in the oil tank body 31 and the oil pump assembly 4.

The gas and pump oil impact the elastic sheet assembly 7 to keep the discharge outlets 32 in the open state; then, the gas passes through the oil mist filter assembly 6 to enter the chamber of the oil tank body 31 and is then discharged to the outside. By means of the gas outlet assembly 10, discharged gas can be filtered; the meshes are formed in an end surface of the gas outlet nut 104, and the filter disc 103 is arranged between the gas outlet nut 104 and the screw connector 101, such that the gas can be discharged from the oil tank body 31 to the outside in only one direction. The partition 38 is arranged to prevent the pump oil from spilling over directly.

Whether a large quantity of oil mist is generated in the oil tank body 31 can be observed by means of the sight glass 14; when a large quantity of oil mist is generated in the oil tank body 31, the gas ballast assembly 8 can be turned on to allow dry gas to enter the oil pump assembly 4 from the outside to reduce the quantity of generated oil mist. In a default state, the third vent hole 811 in the nozzle 82 is misaligned with the first vent hole 89 in the gas ballast plug sleeve 86, such that the nozzle 82 is disconnected from the outside, and the gas ballast assembly 8 is in the off state; when the rotary knob 81 is rotated, the gas ballast link 83 will rotate synchronously, the gas ballast link 83, when rotating, drives the gas ballast plug sleeve 86 to rotate, and the gas ballast plug sleeve 86, when rotating, drives the gas ballast plug 97 to rotate, such that the first vent hole 89 and the third vent hole 811 can be aligned, the nozzle 82 is connected to the vent groove 812, and dry gas enters a chamber of the second-stage pump housing 43 from the outside along the vent groove 812; in the vacuumizing process of the oil pump assembly 4, the gas ballast assembly 8 is turned on, a hole in the second-stage pump housing 43 is connected to the nozzle 82, and gas is continuously compressed to generate water vapor in the chamber of the second-stage pump housing 43; dry gas is fed into the second-stage pump housing 43 by means of the gas ballast assembly 8 to prevent the condensation of a large amount of gas, such that the gas can enter the oil mist filter assembly 6 with the pump oil, the content of water vapor in the gas is decreased, and the generation of a large amount of oil mist is avoided, which may otherwise affect the vacuumizing efficiency. With the reduction in the quantity of oil mist, the pressure of the water vapor will be decreased, thus prolonging the service life of the vacuum pump assembly. The copper contact piece 84 rotating synchronously with the gas ballast link 83 is arranged on the gas ballast link 83, and when the gas ballast link 83 rotates, the contact on the copper contact piece 84 will rotate synchronously; because multiple pairs of contacts are arranged on the gas ballast circuit board 85, the gas ballast circuit board 85 can generate different electric signals to allow the indicator light circuit board 12 to display different states; when the gas ballast assembly 8 is in the on state, an indicator light on the indicator light circuit board 12 flickers red and blue; when the gas ballast assembly 8 is in the off state, the indicator light is blue. In this way, users can visually learn about the on/off state of the gas ballast assembly 8 by observing the state of the indicator light.

The specific embodiments described above are merely for explaining the spirit of the invention by way of examples. Those skilled in the art can make various amendments, supplements or similar substitutions to the specific embodiments described above without deviating from the spirit of the invention or exceeding the scope defined by the appended claims.

What is claimed is:

1. A multifunctional vacuum pump, comprising a shell, a vacuum pump assembly and an oil tank assembly being arranged in the shell, wherein the vacuum pump assembly comprises an oil pump assembly and a motor assembly, a condenser connected to the oil tank assembly is arranged below the oil tank assembly, and an oil inlet tube connecting the condenser and the oil pump assembly is arranged between the condenser and the oil pump assembly; the oil tank assembly comprises an oil tank body, and discharge outlets are formed in the oil tank body and connected to the oil pump assembly; an oil mist filter assembly is arranged above the discharge outlets and comprises an upper protective cover, a lower protective cover and filter elements; an elastic sheet assembly for controlling the discharge outlets to be opened or closed is arranged between the discharge outlets and the upper protective cover; a gas ballast assembly connected to the oil pump assembly is arranged on the shell and comprises a rotary knob and a nozzle, and when the rotary knob is rotated with respect to the shell, the nozzle is in an on or off state; a gas inlet assembly connected to the oil pump assembly is arranged on the shell, and a gas outlet assembly is arranged on a side face of the oil tank body;

the oil tank assembly is arranged above the oil pump assembly and further comprises an oil guard and an oil tank cap; the oil guard is arranged at an open end of the oil tank body, and the oil tank cap is threadedly connected to the oil tank body; a socket extending vertically is arranged on an end cover of the oil tank body, and an indicator light circuit board is arranged in the socket; a main control circuit board is arranged below the oil pump assembly, the indicator light circuit board is electrically connected to the gas ballast assembly, and the gas ballast assembly is electrically connected to the main control circuit board; the discharge outlets are arranged in a chamber of the oil tank body side-by-side, the elastic sheet assembly is arranged on the discharge outlets, and the oil mist filter assembly fitting the oil tank body is arranged above the elastic sheet assembly; a plurality of mounting holes are uniformly formed in a bottom of the oil tank body, and the condenser is arranged below the plurality of mounting holes; a sight glass is arranged on an end surface, facing the socket, of the oil tank body, a stationary press plate connected to the oil tank body is arranged on an outer side of the sight glass, and a sealing strip is arranged between the sight glass and the oil tank body; the gas outlet assembly is arranged on an outer wall of the oil tank body;

the gas ballast assembly comprises the rotary knob, the nozzle, a gas ballast link, a copper contact piece, a gas ballast circuit board, a gas ballast plug sleeve, a gas ballast plug and a gas ballast housing; the gas ballast link and the rotary knob are mounted on two sides of the shell respectively; a mounting groove for mounting the gas ballast link is formed in the shell, and the gas ballast link and the gas ballast plug sleeve are connected and rotate synchronously; the gas ballast plug rotating synchronously with the gas ballast plug sleeve is arranged in the gas ballast plug sleeve and disposed around the nozzle; the gas ballast housing is disposed around an outer layer of the gas ballast plug sleeve, and the gas ballast plug sleeve is allowed to rotate with respect to the gas ballast housing; the gas ballast circuit board is arranged between a head end of the gas ballast housing and the mounting groove, and first fasteners are arranged between the gas ballast housing and the mounting groove; the copper contact piece is mounted on the gas ballast link and rotates synchronously with the gas ballast link, and a contact on the copper contact piece faces contacts on the gas ballast circuit board; a first vent hole is formed in the gas ballast plug sleeve, a second vent hole is formed in the gas ballast plug, and a third vent hole is formed in the nozzle; the gas ballast circuit board is electrically connected to the indicator light circuit board and is further electrically connected to the main control circuit board; a vent groove is formed in the gas ballast housing and arranged in an axial direction of the gas ballast housing;

a cylindrical through-hole is formed in the gas ballast link, a pair of positioning pins are arranged in the cylindrical through-hole, a limit bead is arranged at a tail end of each of the pair of positioning pins and stretches and retracts synchronously with a respective positioning pin of the pair of positioning pins, and a compression spring is arranged between the pair of positioning pins; a plurality of limit grooves are uniformly formed in an inner wall of the mounting groove, and an outline of each of the plurality of limit grooves matches an outline of the limit beads; the first fasteners sequentially penetrate through the gas ballast housing and the gas ballast circuit board and extend to be mounted in the mounting groove; the first vent hole and the second vent hole are arranged coaxially, and the third vent hole faces the vent groove; when the first vent hole and the third vent hole are aligned, the gas ballast assembly is in an on state; when the first vent hole and the third vent hole are misaligned, the gas ballast assembly is in an off state; a first line connecting the nozzle and a second-stage pump housing is arranged between the nozzle and the second-stage pump housing, and a snap ring for fastening the nozzle is arranged on an outer side of the nozzle.

2. The multifunctional vacuum pump according to claim 1, wherein the oil pump assembly comprises a pump cover, a first-stage pump housing, the second-stage pump housing, a first end cover and a second end cover; the first end cover is connected to the pump cover, the pump cover is connected to the second-stage pump housing, the second-stage pump housing is connected to the first-stage pump housing, the first-stage pump housing is connected to the second end cover, and the second end cover is connected to the motor assembly; a long rotor and a pair of long blades are arranged in the first-stage pump housing, and a short rotor and a pair of short blades are arranged in the second-stage pump housing; an oil pump rotor rotating synchronously with the short rotor is arranged on the short rotor, the short rotor and the long rotor rotate synchronously, and the long rotor and the motor assembly rotate synchronously; first springs are arranged between the pair of long blades, and second springs are arranged between the pair of short blades; the second-stage pump housing is connected to the oil tank body, and a first passage connecting the second-stage pump housing and the oil inlet tube is arranged in the oil tank body; the second-stage pump housing is connected to the gas ballast assembly, and the second end cover is connected to the gas inlet assembly.

3. The multifunctional vacuum pump according to claim 2, wherein the oil pump assembly further comprises a first sealing element, a second sealing element, a third sealing element and a fourth sealing element; the first sealing element is arranged between the first end cover and the pump cover, the second sealing element is arranged between the pump cover and the second-stage pump housing, the third sealing element is arranged between the second-stage pump housing and the first-stage pump housing, and the fourth sealing element is arranged between the first-stage pump housing and the second end cover; the oil pump rotor is mounted in an end groove of the short rotor, and an axial length of the pair of long blades is greater than an axial length of the pair of short blades; first guide grooves for mounting the first springs are formed in the pair of long blades, and second guide grooves for mounting the second springs are formed in the pair of short blades; the pair of long blades are mounted on the long rotor and abut against an inner wall of the first-stage pump housing, and the pair of short blades are mounted on the short rotor and abut against an inner wall of the second-stage pump housing; second passages connected to the oil tank body are arranged at a top of the second-stage pump housing and are coaxial with the discharge outlets; a fan blade rotating synchronously with the motor assembly is arranged at an end, facing away from the oil pump assembly, of the motor assembly, and a heat sink is arranged at a bottom of the shell.

4. The multifunctional vacuum pump according to claim 1, wherein the oil mist filter assembly further comprises second fasteners and third fasteners; the lower protective cover is arranged at a horizontal bottom of the oil tank body, and the upper protective cover covering the lower protective cover is arranged on the lower protective cover; the lower protective cover is adjacent to the elastic sheet assembly, a receiving space is defined by the upper protective cover, the lower protective cover and the horizontal bottom of the oil tank body, and the elastic sheet assembly is arranged in the receiving space; the second fasteners for fastening the upper protective cover and the lower protective cover are arranged between the upper protective cover and the lower protective cover, and the third fasteners for fastening the upper protective cover and the oil tank body are arranged between the upper protective cover and the oil tank body; oil outlets are formed in the lower protective cover, crossed barrier strips are arranged at the oil outlets, and the filter elements are arranged on the barrier strips; an outline of the filter elements matches an outline of the oil outlets, and the filter elements fit inner walls of the oil outlets.

5. The multifunctional vacuum pump according to claim 4, wherein the elastic sheet assembly comprises a screw, a flat washer, an elastic washer, a membrane and a sheet body; the membrane is disposed on the discharge outlets, the sheet body is mounted on the membrane, and the screw sequentially penetrates through the sheet body and the membrane and extends to be mounted in the oil tank body; the flat washer and the elastic washer are arranged on the screw, and the flat washer is adjacent to the sheet body.

6. The multifunctional vacuum pump according to claim 1, wherein the condenser is arranged right below the oil tank body and comprises a plurality of condensation passages arranged vertically, and a horizontal passage for connecting the plurality of condensation passages is arranged at tail ends of the plurality of condensation passages; a plurality of cooling fins are uniformly arranged on outer layers of the plurality of condensation passages; the oil inlet tube is arranged in the condensation passage in a middle of the condenser, and a protective mat is arranged between the oil inlet tube and an inner wall of the condensation passage; the oil inlet tube has an end arranged at a bottom of the condensation passage as well as an end inserted into a first passage of the oil tank body; a bucket filter is arranged at a bottom of the oil inlet tube and connected to the oil inlet tube by interference fit; a partition is arranged on a side face of the oil tank body, and the gas outlet assembly is arranged at an open end of the partition; the gas outlet assembly comprises a screw connector, a sealing ring, a filter disc and a gas outlet nut; the screw connector is threadedly connected to the open end of the partition, and the gas outlet nut is threadedly connected to the screw connector; a clamping groove for mounting the sealing ring is formed in an outer wall of the screw connector, and the sealing ring is connected to the clamping groove by interference fit; the filter disc is arranged between a tail end of the screw connector and meshes of the gas outlet nut, and the filter disc fits the meshes of the gas outlet nut.

7. The multifunctional vacuum pump according to claim 1, wherein the gas inlet assembly comprises a gas inlet connector, and gas inlets with different diameters are formed in the gas inlet connector; a threaded protective sleeve is arranged at each gas inlet, and fifth sealing elements are arranged at the gas inlets, wherein diameters of the fifth sealing elements correspond to the diameters of the gas inlets; a gas inlet cover plate for fastening the gas inlet connector and the shell is arranged between the gas inlet connector and the shell, a bent tube for connecting the gas inlet connector and a second end cover is arranged between the gas inlet connector and the second end cover, and an anti-backflow ball is arranged at an end, facing the second end cover, of the bent tube.

* * * * *